US006498594B1

(12) United States Patent
Nunomura

(10) Patent No.: US 6,498,594 B1
(45) Date of Patent: Dec. 24, 2002

(54) PLASMA DISPLAY PANEL AND METHOD OF DRIVING THE SAME

(75) Inventor: Keiji Nunomura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/441,711

(22) Filed: Nov. 16, 1999

(30) Foreign Application Priority Data

Nov. 16, 1998 (JP) ..... 10-341178

(51) Int. Cl.[7] ..... G09G 3/28
(52) U.S. Cl. ..... 345/60; 345/67
(58) Field of Search ..... 345/60–68, 72; 315/169.1, 169.3, 169.4; 313/581, 582, 585–587, 484–487

(56) References Cited

U.S. PATENT DOCUMENTS

| | | | | |
|---|---|---|---|---|
| 4,772,884 A | | 9/1988 | Weber et al. | |
| 5,852,347 A | | 12/1998 | Marcotte | |
| 6,072,449 A | * | 6/2000 | Amemiya | 345/67 |
| 6,157,354 A | * | 12/2000 | Amemiya | 345/60 |

FOREIGN PATENT DOCUMENTS

| | | | |
|---|---|---|---|
| EP | 0 762 373 | | 3/1997 |
| EP | 0762373 | * | 3/1997 |
| EP | 0 860 849 | | 8/1998 |
| EP | 0 993 017 | | 4/2000 |
| JP | 5-266800 | | 10/1993 |
| JP | 05-266801 | | 10/1993 |
| JP | 5-299022 | | 11/1993 |
| JP | 06-044907 | | 2/1994 |
| JP | 7-65728 | | 3/1995 |
| JP | 8-212933 | | 8/1996 |
| JP | 08-315735 | | 11/1996 |
| JP | 9-35644 | | 2/1997 |
| JP | 09-120777 | | 5/1997 |
| JP | 09-160525 | | 6/1997 |
| JP | 10-149774 | | 6/1998 |
| JP | 10-247072 | | 9/1998 |
| JP | 10-255667 | | 9/1998 |
| JP | 11-149873 | | 6/1999 |
| JP | 11-272232 | | 10/1999 |
| JP | 11272232 | | 10/1999 |
| JP | 11-273573 | | 10/1999 |
| JP | 11305212 | | 11/1999 |
| JP | 2000-113828 | | 4/2000 |
| KR | 1998-75089 | | 11/1998 |

* cited by examiner

*Primary Examiner*—Regina Liang
(74) *Attorney, Agent, or Firm*—Choate, Hall & Stewart

(57) ABSTRACT

A plasma display panel in which deterioration of luminance accompanied by an increase in resolution can be improved. The plasma display panel comprises a plurality of center slit surface discharge electrodes extending in a first direction, each of the center slit surface discharge electrodes having a pair of surface discharge electrode portions formed of a pair of transparent electrodes and a bus electrode which electrically couples said pair of transparent electrodes with each other, and a center slit between the surface discharge electrode portions. A plurality of data electrodes extend in a second direction which crosses the first direction of extension of the center slit surface discharge electrodes. A surface discharge gap is formed between adjacent the center slit surface discharge electrodes.

12 Claims, 18 Drawing Sheets

<ODD FIELD>

<EVEN FIELD>

<EVEN FIELD>

<ODD FIELD>

200
2
10
6
5
9
9
PRIOR ART

PRIOR ART

PRIOR ART

PLASMA DISPLAY PANEL AND METHOD OF DRIVING THE SAME

FIELD OF THE INVENTION

The present invention relates generally to a plasma display panel (PDP) used in a flat panel type television set, a display for displaying information, and the like and a method of driving the plasma display panel. More particularly, the present invention relates to a plasma display panel which has high resolution and high luminance, and to a method of driving such plasma display panel.

BACKGROUND OF THE INVENTION

A plasma display is a display device which displays an image and so on by exciting fluorescent substance by using ultraviolet rays produced by gas discharge to emit light. The plasma display is expected to be applied to a large picture size television set, an information display, and the like.

Various types of color plasma displays have been developed. As typical types of the color plasma displays, there are a DC pulse memory type display and an AC memory type display. At present, the AC memory type is mainly used because of the lifetime and the luminous efficiency. The AC memory type display is also categorized into an opposed electrode discharge type, a surface discharge type, and the like, depending on the cell structure, the electrode structure and so on. In particular, a reflection type AC surface discharge type plasma display is superior in the luminance, easiness of panel fabrication, and the like.

FIGS. 16A through 16C illustrate a panel structure of a typical reflection type AC surface discharge color plasma display. FIG. 16A is an elevational structural view in which a portion of a rear substrate 200 is cut away. FIG. 16B illustrates a structure at a cross section of a front substrate 100. FIG. 16C illustrates a structure at a cross section of the rear substrate 200.

The front substrate 100 which is on the side of a viewer comprises a glass substrate 1 and many band shaped transparent electrodes 3 formed in parallel on the glass substrate 1, in a horizontal direction. On each of the transparent electrodes 3, a bus electrode 4 is formed which bus electrode 4 is a band shaped narrow electrode to lower resistance of the transparent electrode 3. The transparent electrodes 3 are formed of a thin film of ITO (Indium Tin Oxide) or tin oxide. However, the resistance of each transparent electrode 3 should be sufficiently small in order to conduct a discharge current sufficient to emit light in a large size panel, and, therefore, the bus electrode 4 made of metal having good conductivity is attached to each of the transparent electrodes 3 to lower the resistance thereof. The bus electrode 4 is made, for example, of a thick film of silver or a thin film of copper, aluminum, or chromium, and is formed on the transparent electrode 3 near the side of a non-discharge gap 12 where intensity of light emission is low.

On such structure including the transparent electrodes 3 and the bus electrodes 4, a dielectric layer 7 and a protective layer 8 are formed. The dielectric layer 7 is fabricated by applying a low melting point glass paste on the structure including the electrodes 3 and 4, and thereafter baking it at a temperature near 600 degrees Celsius. Thereby, the dielectric layer 7 is formed as a transparent insulating layer having a thickness of approximately 20 through 40 microns. The protective layer 8 is formed by vacuum evaporation and the like, and formed of a thin film of magnesium oxide (MgO) which has a large coefficient of secondary electron emission and has a superior anti-sputtering characteristic.

The rear substrate 200 comprises a glass substrate 2 on which band shaped data electrodes 5 are formed in a vertical direction and, thereafter, a dielectric layer 10 having low melting point glass as the basis is formed thereon. Thereafter, band shaped isolation walls 6 are formed in a vertical direction on the dielectric layer 10. Then, at a bottom portion and sidewalls of each groove formed by the isolation walls 6, powder type fluorescent substance 9 of red, green and blue colors are sequentially applied, and thereby the rear substrate 200 is completed. The isolation walls 6 secure discharge spaces, and serve to prevent cross talk of discharge and to prevent blotting of emitted light. Approximately, the isolation walls 6 are 30 through 100 microns in width and 80 through 200 microns in height.

The above-mentioned front substrate 100 and the rear substrate 200 are opposed to each other such that the protective layer 8 of the front substrate 100 is opposed to the isolation walls 6 of the rear substrate 200. Both substrates 100 and 200 are then sealed at the periphery thereof by a fritted glass to obtain a panel assembly. The panel assembly is heated and evacuated, and discharge gas having rare gas as the basis thereof is introduced, thereby the plasma display panel is completed.

On the front substrate 100, the transparent electrodes 3 with the bus electrodes 4 are disposed in pairs having a surface discharge gap 11 therebetween. One of the pair of transparent electrodes 3 with bus electrodes 4 is used as a scanning electrode 13, and the other of the pair is used as a retaining or holding electrode 14. Between the pairs of transparent electrodes 3 with bus electrodes 4, the non-discharge gaps 12 each having a relatively large width are provided to avoid cross talk of discharge. Various voltage wave signals are applied to three kinds of electrodes, including the data electrodes 5 mentioned above, in addition to these scanning electrodes 13 and the retaining electrodes 14, thereby the plasma display panel is driven to perform display operation.

FIG. 17 shows an example of waveforms of fundamental drive signals for the AC surface discharge type plasma display panel. Scanning pulses Sc1, Sc2, . . . , ScN are sequentially applied to the scanning electrodes 13-1, 13-2, . . . , 13-N. At the same timing as that of each of the scanning pulses Sc1, Sc2, . . . , ScN, a data pulse Dp is sequentially applied to each of the data electrodes 5 corresponding to a data to be displayed at each display cell. The data pulses have a polarity opposite to that of the scanning pulses. Thereby, a discharge, that is, an opposing electrode discharge, occurs between the scanning electrode 13 and the data electrode 5 opposing to each other. Also, the opposing electrode discharge triggers occurrence of the surface discharge between the retaining electrode 14 and the scanning electrode 13, thereby writing operation is completed. Due to the surface discharge, i.e., a writing discharge, wall charges are produced on the surfaces over the scanning electrode 13 and the retaining electrode 14. In a cell in which wall charges are formed, retaining discharge of the surface discharge, i.e., retaining surface discharge, occurs by retaining pulses Re applied between the retaining electrode 14 and the scanning electrode 13. However, in a cell into which data is not written, retaining discharge does not occur even if the retaining pulses Re are applied, because there is no superimposing effect of electric fields caused by the wall charges. By applying the retaining pulses predetermined times, display of image and so on by light emission is performed.

Also, in order to improve write operation characteristic, a preliminary discharge operation is performed in which a high voltage is applied to all cells before performing write operation, so that any previously stored signals of the cells are erased and discharge is performed forcibly. In FIG. 17, Pd designates a preliminary discharge pulse, and Pe designates preliminary erasure discharge pulse.

As mentioned above, drive operation of a plasma display panel comprises a series of preparing operation, write operation and retained light emission operation. In FIG. 17, a series of such driving operation is shown as an example, in which driving operation of a plasma display panel is separated into a preparing interval in a whole panel, a write interval and a retaining interval. Various driving systems other than the above-mentioned system in which write operation and retain operation are separated can be used, for example, it is possible to use a system in which these operations are mixed. However, when considered in an individual display cell, it is common to these systems that, after preparing operation, write operation is disposed and then retaining operation is disposed.

When tone or gradation of an image and so on is to be displayed in a plasma display panel, a so-called "sub-field method" is used. In the AC type plasma display, it is difficult to modulate luminance of display emission by using voltage control, and, in order to modulate luminance, it is necessary to change number of times of light emission. In the sub-field method, an image of one page is divided into a plurality of pages of binary images and these binary images are continuously displayed in a high speed so that, by using integrating effect of vision, an image having multiple gradation is reproduced.

However, the above-mentioned prior art plasma display panel has the following disadvantages.

Although the surface discharge type AC plasma display panel has a superior display characteristic, as seen from the structure of the surface discharge electrodes shown in FIG. 16A through FIG. 16C, this plasma display panel needs a pair of electrodes for light emission of one pixel row. The width of each of the surface discharge gaps 11 is approximately 50 through 100 microns and is relatively narrow. However, the non-discharge gap 12 between adjacent pixel rows, that is, between an upper pixel row and a lower pixel row, should be relatively wide to avoid cross talk of discharge. Usually, it is necessary that the width of the non-discharge gap 12 is approximately two or three times as that of the surface discharge gap 11. It is also necessary that the width of each bus electrode 4 made of a metal has a width of approximately 100 microns or more due to the limitation of specific resistance of the metal of the bus electrode 4 and of fabrication technology. By these restrictions, it becomes difficult to increase the area of the electrodes themselves, and to enlarge optically opening portions where light emitted from the fluorescent substance 9 is not obstructed. Therefore, in a plasma display panel having a high resolution and a narrow pixel pitch, it becomes difficult to realize high luminance.

Also, as the resolution of a plasma display panel becomes high, a number of pixel rows becomes large and it is necessary to shorten a scanning time required for writing data into pixels of one row. As a scanning time for one row, approximately 3 microseconds are usually permissible in a usual television system, for example, an NTSC system, or in VGA system having 480 rows, even if a full color image is displayed by using the sub-field method. However, in the high-vision television system or a high resolution digital television system each having approximately 1000 pixel rows, it is necessary to surely perform writing operation within a scanning time equal to or shorter than approximately 1.5 microseconds. To realize the write operation in such a short time, a high speed drive of a plasma display panel is one of major concerns.

As a measure of improving the above-mentioned items, there is provided a plasma display panel in which an isolation wall is provided in a central portion of each of wide transparent electrodes and thereby decreasing a number of the transparent electrodes by half. FIG. 18A illustrates a cross sectional structure of such plasma display panel. As shown in FIG. 18A, a bus electrode 4 is provided in the central portion of each of wide transparent electrodes 3, and an isolation wall 15 is disposed over each of the bus electrodes 4. Also, FIG. 18B illustrates a cross sectional structure of a conventional commonly used plasma display panel for reference. In the structure of FIG. 18A, the non-discharge gaps 12 in the plasma display panel shown in FIG. 18B are not provided, and a proportion of aperture, or an optically opening portion where light emitted from the fluorescent substance 9 is not obstructed, can be made relatively large. Therefore, it is expected that display having a high luminance can be realized. However, there is a disadvantage that the isolation walls 15 can not easily be fabricated. Also, when the isolation walls 15 are disposed in addition to the isolation walls 6 which are disposed in stripes and which are disposed perpendicular to the surface discharge electrodes, evacuation conductance is decreased greatly in a manufacturing process and, therefore, panel characteristics are deteriorated.

SUMMARY OF THE INVENTION

Considering the problems mentioned above, the present invention has been thought out.

It is an object of the present invention to obviate the disadvantages of conventional plasma display panels.

It is another object of the present invention to provide a plasma display panel in which a decrease in luminance accompanied by an increase in resolution can be improved.

It is still another object of the present invention to provide a plasma display panel in which difficulty in driving the plasma display panel caused by an increase in resolution can be obviated.

It is still another object of the present invention to provide a plasma display panel which has high resolution, but which has a simple structure and is inexpensive.

According to an aspect of the present invention, there is provided a plasma display panel comprising: a plurality of center slit surface discharge electrodes extending in a first direction, each of the center slit surface discharge electrodes having a pair of surface discharge electrode portions and a center slit between the surface discharge electrode portions; surface discharge gaps each formed between adjacent the center slit surface discharge electrodes; and a plurality of data electrodes extending in a second direction which crosses the first direction of extension of the center slit surface discharge electrodes.

In this case, it is preferable that each of the center slit surface discharge electrodes comprises the pair of surface discharge electrode portions which are formed of a pair of transparent electrodes and which are disposed parallel to each other via the center slit, and a bus electrode which electrically couples the pair of transparent electrodes with each other.

It is possible to provide the plasma display panel with isolation walls which are disposed parallel with the data electrodes and which define discharge spaces for display cells.

It is also preferable that the bus electrode comprises a pair of elongated bus electrode portions which are disposed parallel to the center slit on the pair of transparent electrodes and which are mutually connected on both ends thereof at the locations outside the center slit surface discharge electrode, thereby the pair of the transparent electrodes are mutually electrically coupled via the bus electrode.

In this case, the pair of elongated bus electrode portions can be electrically coupled via a plurality of coupling portions formed at locations facing the isolation walls, thereby the bus electrode constitutes approximately a ladder shaped conductor.

It is preferable that the bus electrode has approximately a serpentine shape and electrically couples the pair of transparent electrodes with each other via portions of the bus electrode extending approximately in the second direction and extending at locations facing the isolation walls.

Also, it is preferable that each of the pair of transparent electrodes is divided into a plurality of approximately oblong card shaped portions which are separated at locations facing isolation walls.

Further, it is preferable that each of the pair of transparent electrodes has approximately comb like shape in which a plurality of cut in portions are provided approximately at locations facing isolation walls from the surface discharge gap side toward the center slit side.

It is preferable that the pair of transparent electrodes have a pair of band shaped portions and a plurality of coupling portions which are located in the center slit and which electrically couple the band shaped portions at the locations facing the isolation walls, and the bus electrode is a band shaped bus electrode which is disposed approximately in the central portion of the center slit and which is electrically coupled with the plurality of coupling portions.

It is also preferable that the bus electrode is a fish-bone shaped bus electrode which is disposed approximately in the central portion of the center slit and which has a plurality of branch portions extending in the second direction at locations facing the isolation walls, and the pair of transparent electrodes are electrically coupled with each other via the plurality of branch portions.

It is possible for each of the data electrodes to have wide portions in the proximity of the surface discharge gaps between adjacent the center slit surface discharge electrodes, and to have narrow portions in the proximity of the center slits.

It is also possible to provide a colored layer is formed in the proximity of each of the center slits.

It is preferable that the center slit surface discharge electrodes are grouped alternately into S electrodes and C electrodes, a scanning driver for applying scanning pulses is connected to each of the S electrodes, and the C electrodes are grouped into a group of C electrodes of odd number and a group of C electrodes of even number, each of the groups of C electrodes being electrically coupled together.

According to another aspect of the present invnetion, there is provided a method of driving a plasma display panel comprising: providing a plurality of center slit surface discharge electrodes extending in a first direction, each of the center slit surface discharge electrodes having a pair of surface discharge electrode portions and a center slit between the surface discharge electrode portions; providing a plurality of data electrodes extending in a second direction which crosses the first direction of extension of the center slit surface discharge electrodes; forming surface discharge gaps each between adjacent the center slit surface discharge electrodes; and performing data write operation between the center slit surface discharge electrodes and the data electrodes by applying scanning pulses to the center slit surface discharge electrodes and by applying data pulses to the data electrodes depending on data to be displayed, thereby performing display operation.

It is preferable that the method further comprises: grouping the center slit surface discharge electrodes alternately into C electrodes and S electrodes; connecting a scanner driver to each of the S electrodes, the scanner driver supplying the scanning pulses; grouping the discharge gaps to be driven for display to those of odd field and of even field; in the odd field, applying the scanning pulses to the S electrodes of odd number to perform write operation between the S electrodes and the data electrodes; in a retaining period of the scanning pulse, alternately applying retaining pulses to the S electrode and the C electrode of a pixel row of odd number which corresponds to the odd field; applying in phase signals to the S electrode and the C electrode of a pixel row of even number which corresponds to the even field, thereby performing retained discharge of the pixel row of odd number; in the even field, applying the scanning pulses to the S electrodes of even number to perform write operation between the S electrodes and the data electrodes; in a retaining period of the scanning pulse, alternately applying retaining pulses to the S electrode and the C electrode of a pixel row of even number which corresponds to the even field; and applying in phase signals to the S electrode and the C electrode of a pixel row of odd number which corresponds to the odd field, thereby performing retained discharge of the pixel row of even number, thereby performing display operation in whole picture.

It is also preferable that the method further comprising: grouping the discharge gaps to be driven for display to those of odd field and of even field; in the odd field, applying the scanning pulses to the center slit surface discharge electrodes of odd number to perform write operation between the electrodes and the data electrodes; in a retaining period of the scanning pulse, alternately applying retaining pulses to the center slit surface discharge electrode of odd number and the center slit surface discharge electrode of even number; performing light emission by retained discharge which is the same in two rows in the pixel rows on both sides of the center slit surface discharge electrode of odd number into which write operation is performed; in the even field, applying the scanning pulses to the center slit surface discharge electrodes of even number to perform write operation between the electrodes and the data electrodes; in a retaining period of the scanning pulse, alternately applying retaining pulses to the center slit surface discharge electrode of even number and the center slit surface discharge electrode of odd number; performing light emission by retained discharge which is the same in two rows in the pixel rows on both sides of the center slit surface discharge electrode of even number into which write operation is performed, thereby performing display operation in whole picture.

It is further preferable that the method further comprises: grouping the discharge gaps to be driven for display into those of odd field and of even field; in the odd field, applying the scanning pulses to the center slit surface discharge electrodes of odd number to perform write operation between the electrodes and the data electrodes; in a retaining period of the scanning pulse, applying the same retaining pulses to the center slit surface discharge electrodes of even number adjacent to an upper portion or a lower portion of the center slit surface discharge electrode of odd number; alternately applying the retaining pulses whose phases differ by a half pitch to the center slit surface discharge electrodes of even number adjacent lower portion or upper portion of the center slit surface discharge electrode of odd number; performing light emission by retained discharge in the pixel row located on the lower or the upper side of the center slit surface discharge electrode of odd number; in the even field, applying the scanning pulses to the center slit surface discharge electrodes of even number to perform write operation between the electrodes and the data electrodes; in a retaining period of the scanning pulse, applying the same retaining pulses to the center slit surface discharge electrodes of odd number adjacent to an upper portion or a lower portion of the center slit surface discharge electrode of even number; alternately applying the retaining pulses whose phases differ by a half pitch to the center slit surface discharge electrodes of odd number adjacent to a lower portion or an upper portion of the center slit surface discharge electrode of even number; performing light emission by retained discharge in the pixel row located on the lower or the upper side of the center slit surface discharge electrode of even number, thereby performing display operation in whole picture.

It is also preferable that the above-mentioned various methods of driving a plasma display panel are switchable to perform display operation of a plasma display panel.

BRIEF DESCRIPTION OF THE DRAWINGS

These and other features, and advantages, of the present invention will be more clearly understood from the following detailed description taken in conjunction with the accompanying drawings, in which like reference numerals designate identical or corresponding parts throughout the figures, and in which.

DESCRIPTION OF A PREFERRED EMBODIMENT

With reference to the drawings, embodiments of the present invention will now be described in detail. In the following description, a panel structure of a plasma display panel according to each embodiment is first described, mainly on electrode structure and shape. Then, description will be made on various method of driving the plasma display panel.

[Embodiment 1]

Figure 1:
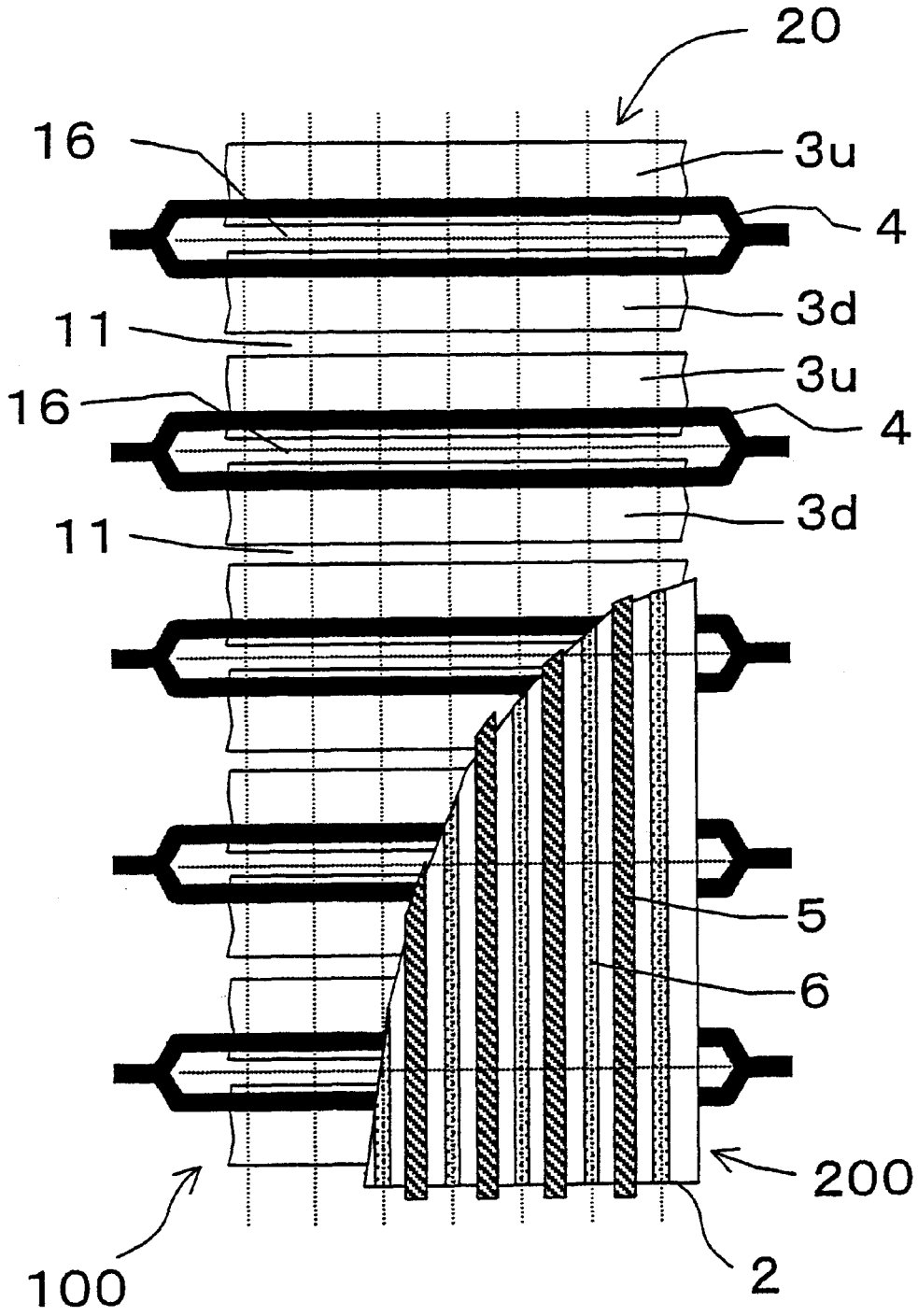
FIG. 1 is an elevational view illustrating an electrode structure of a plasma display panel according to a first embodiment of the present invention in which a portion of a rear substrate is cut away.

FIG. 1 illustrates a panel structure of a plasma display panel according to a first embodiment of the present invention. In FIG. 1, a structure of surface discharge electrodes of a front substrate 100 is shown in detail and a portion of a rear substrate 200 is cut away for the sake of easy understanding. The plasma display panel of FIG. 1 is the same as the plasma display panel of FIGS. 16A through 16C, except the structure of surface discharge electrodes, and can be manufactured similarly to the conventional plasma display panel.

The front substrate 100 comprises a glass substrate not shown in the drawing (corresponding to the glass substrate 1 of FIG. 16A) on which many center slit surface discharge electrodes 20 are formed in parallel, for example, in a horizontal direction. Each of center slit surface discharge electrodes 20 comprises a pair of band shaped transparent electrode portions 3*u* and 3*d* formed parallel to each other via a center slit 16 therebetween. Bus electrodes 4 are formed on the transparent electrode portions 3*u* and 3*d*. The bus electrode 4 formed on the transparent electrode portion 3*u* and the bus electrode 4 formed on the transparent electrode portion 3*d* are electrically coupled together on both end portions thereof, that is, outside a display area of the plasma display panel. Therefore, the transparent electrode portion 3*u* and the transparent electrode portion 3*d* constituting surface discharge electrodes are electrically coupled with each other, and called as the center slit surface discharge electrode 20. Many center slit surface discharge electrodes 20 are disposed in parallel on the glass substrate via surface discharge gaps 11 therebetween.

Each of the bus electrode 4 is a band shaped narrow electrode to lower resistance of the transparent electrode portions 3*u* and 3*d*. The transparent electrode portions 3*u* and 3*d* are formed of a thin film of, for example, ITO (Indium Tin Oxide) or tin oxide. Since the resistance of each transparent electrode portions 3*u* and 3*d* should be sufficiently small such that a discharge current sufficient to emit light can be conducted throughout a large size panel, the bus electrode 4 made of metal having good conductivity is attached to each of the transparent electrode portions 3*u* and 3*d* to lower the resistance thereof. The bus electrode 4 is made, for example, of a thick film of silver or a thin film of copper, aluminum, or chromium. On such structure including the transparent electrode portions 3*u* and 3*d* and the bus electrodes 4, a dielectric layer and a protective layer are formed similarly to the dielectric layer 7 and the protective layer 8 of the plasma display panel shown in FIGS. 16A through 16C. For example, the dielectric layer is fabricated by applying a low melting point glass paste on the structure including the electrode portions 3*u*, 3*d* and 4, and thereafter baking it at a temperature near 600 degrees Celsius. Thereby, the dielectric layer 8 is formed as a transparent insulating layer having a thickness of approximately 20 through 40 microns. The protective layer is formed by vacuum evaporation and the like of magnesium oxide (MgO) which has a large coefficient of secondary emission and has a superior anti-sputtering characteristic.

Figures 16A, 16B, 16C:
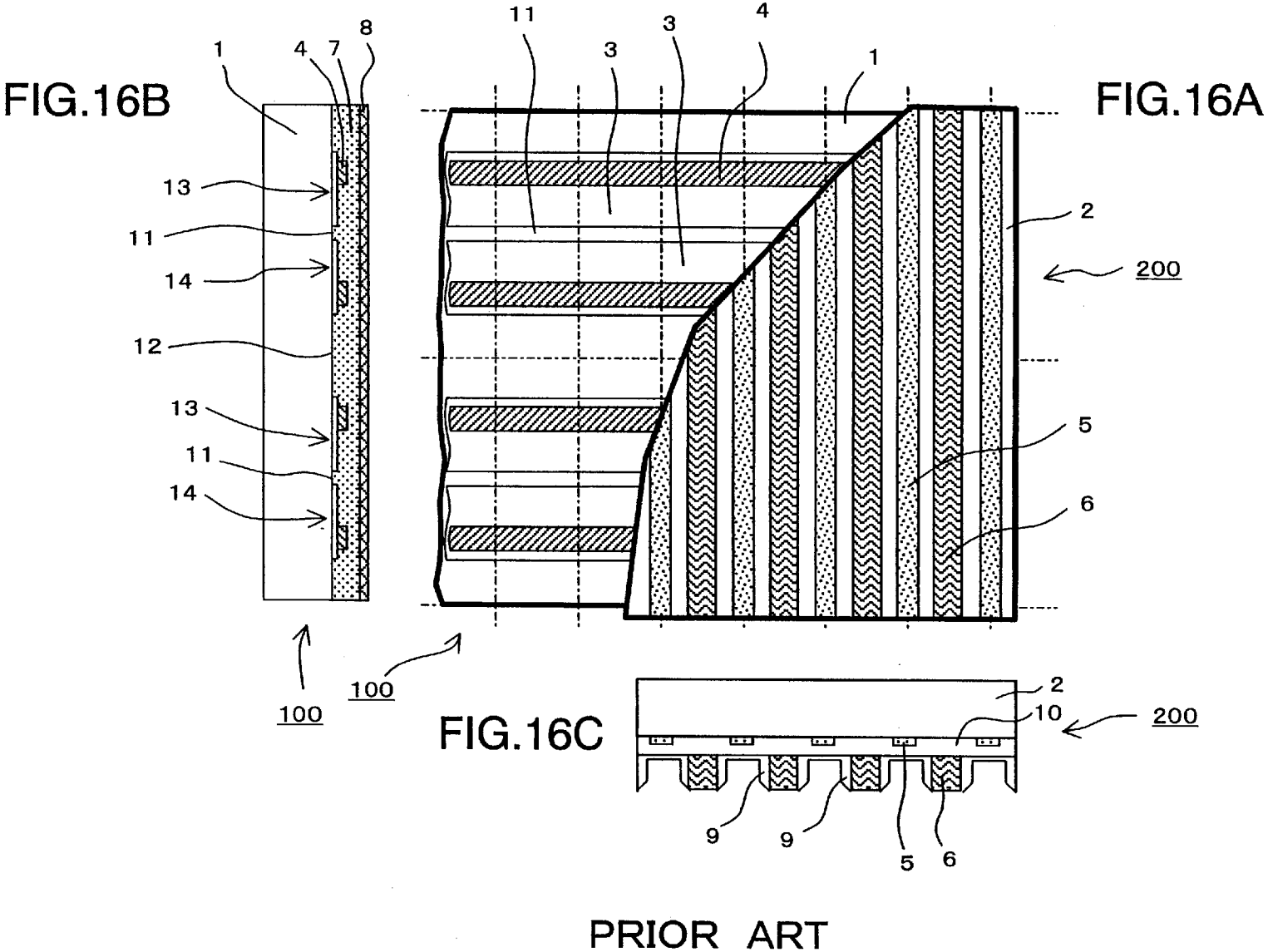
FIG. 16A is an elevational view illustrating a structure of a conventional plasma display panel.
FIG. 16B is a side view of a front substrate of the conventional plasma display panel of FIG. 16A.
FIG. 16C is a bottom view of a rear substrate of the conventional plasma display panel of FIG. 16A.
Figure 17:
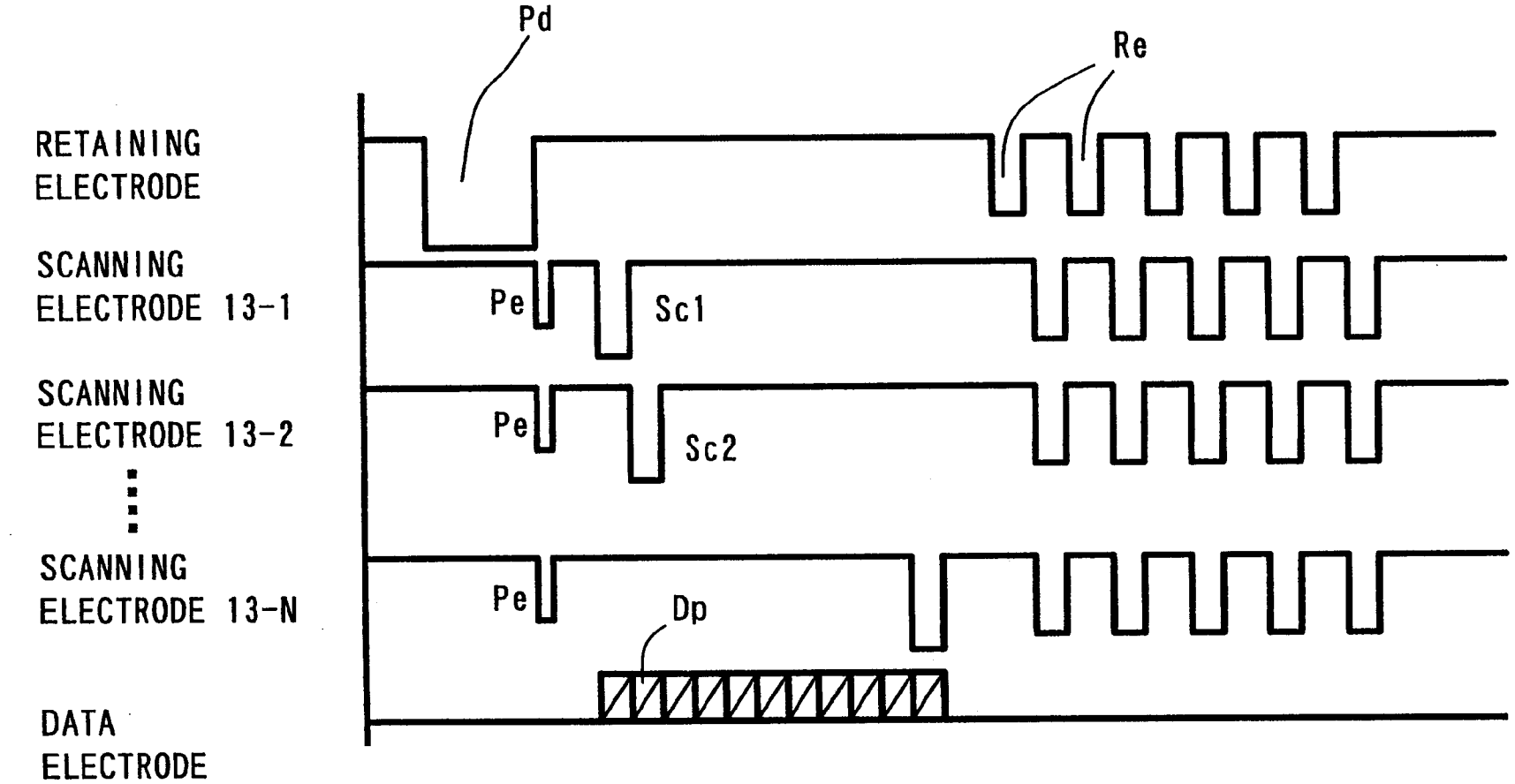
FIG. 17 is a waveform diagram showing waveforms of various drive signals of the plasma display panel of FIG. 16A through FIG. 16C.
Figure 18A:
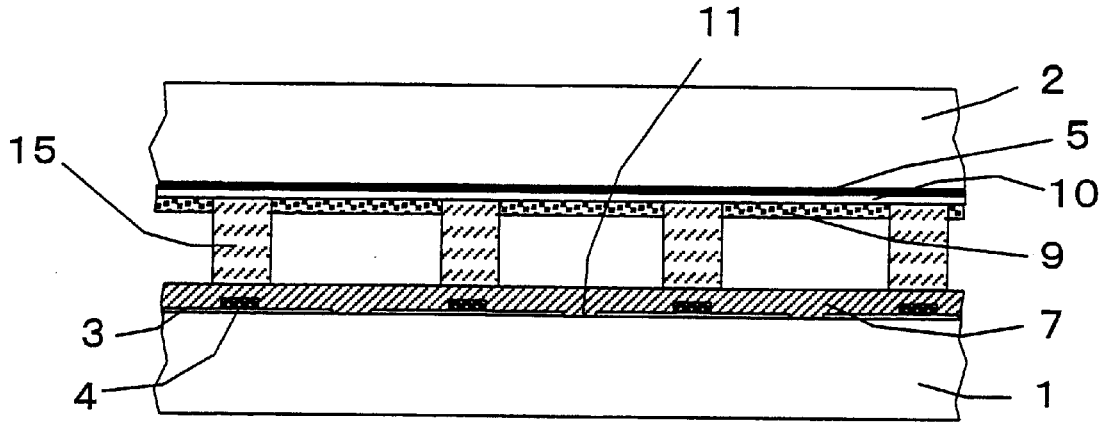
FIG. 18A and FIG. 18B are cross sectional views illustrating cross sectional structures of conventional plasma display panels.
Figure 18B:
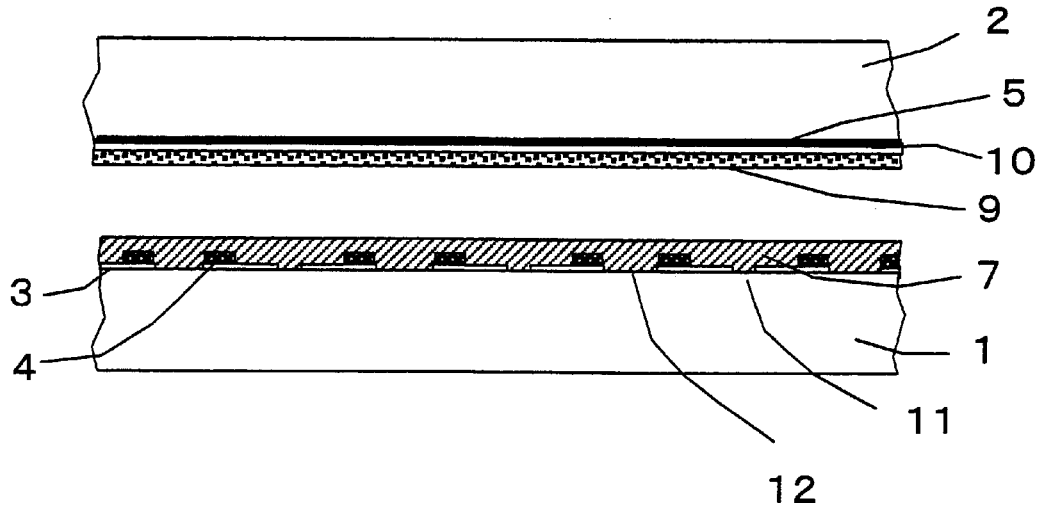
PRIOR ART FIG.18B

The rear substrate 200 has, for example, the same structure as the rear substrate 200 shown in FIGS. 16A and 16C, and fabricated similarly. That is, the rear substrate 200 comprises a glass substrate 2 on which band shaped data electrodes 5 are formed, for example, in a vertical direction and thereafter a dielectric layer (corresponding to a dielectric layer 10 of FIG. 16C) having low melting point glass as the basis is formed thereon. Thereafter, band shaped isolation walls 6 are formed in a vertical direction on the dielectric layer. Then, at a bottom portion and side walls of each groove formed by the isolation walls 6, powder type fluorescent substances (fluorescent substances 9 of FIG. 16C) of red, green and blue colors are sequentially applied, and thereby the rear substrate 200 is fabricated. The isolation walls 6 secure discharge spaces, and serve to prevent cross talk of discharge and to prevent blotting of emitted light. Approximately, the isolation walls 6 are 30 through 100 microns in width and 80 through 200 microns in height.

The above-mentioned front substrate 100 and the rear substrate 200 are opposed to each other such that the protective layer (the protective layer 8 of FIG. 16B) of the front substrate 100 opposes to the isolation walls 6 of the rear substrate 200. Both substrates 100 and 200 are then sealed at the periphery thereof by a fritted glass to obtain a panel assembly. The panel assembly is heated and evacuated, and discharge gas having rare gas as the basis is enclosed, thereby the plasma display panel is completed.

[Embodiment 2]

Figure 2:
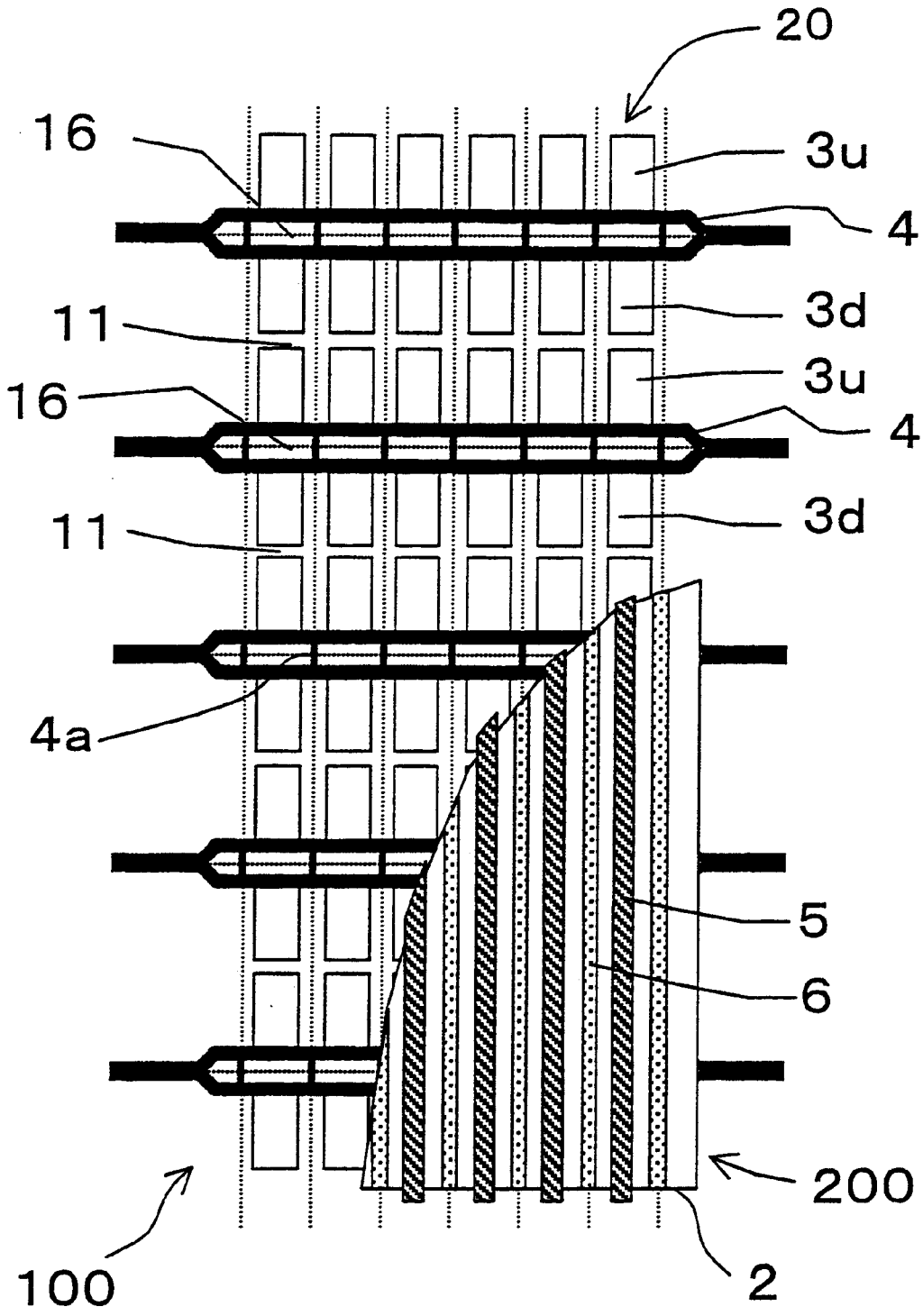
FIG. 2 is an elevational view illustrating an electrode structure of a plasma display panel according to a second embodiment of the present invention in which a portion of a rear substrate is cut away.

FIG. 2 illustrates a panel structure of a plasma display panel according to a second embodiment of the present invention. In FIG. 2, a structure of surface discharge electrodes of a front substrate 100 is shown in detail and a portion of a rear substrate 200 is cut away. The plasma display panel of FIG. 2 is the same as the plasma display panel of FIG. 1, except the structure of surface discharge electrodes.

In the plasma display panel of FIG. 2, each of transparent electrode portions 3*u* and 3*d* is patterned into an oblong card shape. The transparent electrode portion 3*u* on the upper side and the transparent electrode portion 3*d* on the lower side are electrically coupled to a bus electrode 4 having approximately a ladder shape. In the bus electrode 4, each of connecting portions 4*a* corresponding to a step of the ladder is patterned such that the step is positioned at the location of the isolation wall 6. Each space between the connecting portions 4*a*, i.e., the steps of the ladder, corresponds to a center slit 16.

In FIG. 2, the connecting portions 4*a* of the bus electrode 4 are disposed at pitches of the isolation walls 6. However, the connecting portions 4*a* can be thinned out to decrease the number thereof For example, the pitch of the connecting potions 4*a* can be three times as that of the isolation walls 6, and the connecting portions 4*a* can be disposed every set of pixels of three primary colors.

When compared with the simple bus electrodes 4 shown in FIG. 1, in the bus electrodes 4 shown in FIG. 2 and having a ladder shape, even if the bus electrodes 4 has partially a small disconnection, the bus electrodes 4 are not broken down as a whole, because the bus electrodes 4 have a bypass connection. Therefore, it is possible to improve a manufacturing yield of a plasma display panel. Also, by the effect of the connecting portions 4*a*, it is possible to reduce resistance of the bus electrode 4, or to narrow a width of the electrode 4 while retaining the same resistance as before to obtain a higher luminance.

Although the shape of the bus electrodes 4 shown in FIG. 2 becomes somewhat complex, such bus electrodes 4 can be easily fabricated by using photolithography using photosensitive silver paste, etching of a metal film, and the like. Also, in FIG. 2, each of the transparent electrodes 3*u* and 3*d* has an oblong shape to improve luminous efficiency and the like. However, it is possible to combine the bus electrodes 4 having the ladder shape with the simple band shaped transparent electrodes 3 shown in FIG. 3 or with transparent electrodes 3 having even more complex shape.

[Embodiment 3]

Figure 3:
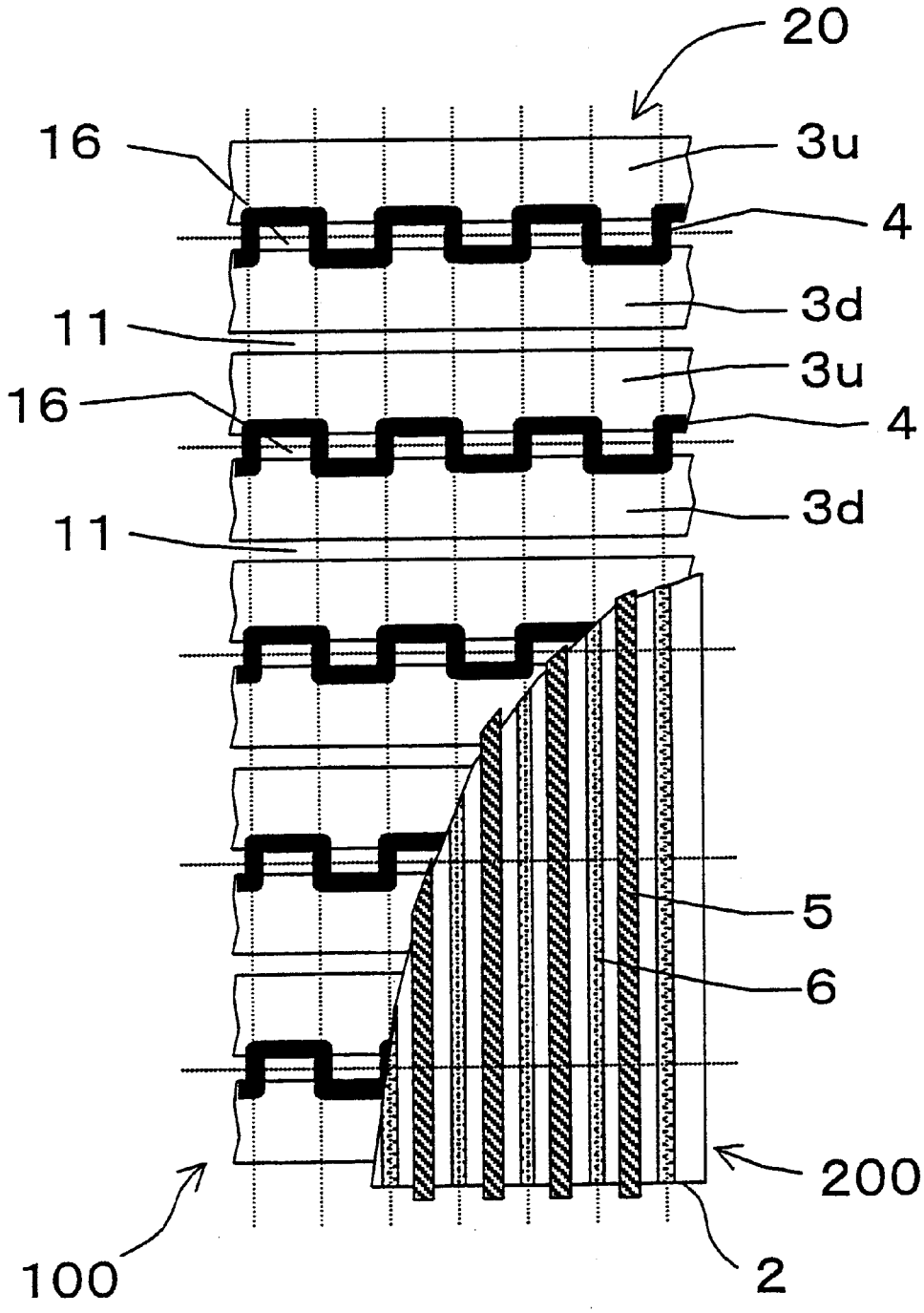
FIG. 3 is an elevational view illustrating an electrode structure of a plasma display panel according to a third embodiment of the present invention in which a portion of a rear substrate is cut away.

FIG. 3 illustrates a panel structure of a plasma display panel according to a third embodiment of the present invention. In FIG. 3, a structure of surface discharge electrodes of a front substrate 100 is shown in detail and a portion of a rear substrate 200 is cut away. The plasma display panel of FIG. 3 is the same as the plasma display panel of FIG. 1, except the structure of surface discharge electrodes.

In the plasma display panel of FIG. 3, each of center slit surface discharge electrodes comprises an upper transparent electrode portion 3*u* and a lower transparent electrode portion 3*d*. Similarly to those of the first embodiment, the upper transparent electrode portion 3*u* and the lower transparent electrode portion 3*d* of this embodiment are band shaped electrodes and are disposed parallel to each other via a center slit 16. However, each of bus electrodes 4 has a serpentine shape. Vertical portions, i.e., portions of each of the bus electrodes 4 which extend along a vertical direction and which electrically couple the upper transparent electrode 3*u* and the lower transparent electrode 3*d* are disposed at the location corresponding to isolation walls 6. Therefore, when the front panel 100 and the rear panel 200 are assembled into a plasma display panel, only center slit portions 16 remain in each discharge space. Although the function of the bus electrodes 4 is to reduce effective resistance of the transparent electrodes 3*u* and 3*d,* the function of the bus electrodes 4 is not deteriorated because a pitch of the vertical portions of the bus electrode 4 can be equal to the pitch of the isolation walls 6. Also, it is possible to extend the pitch of the vertical portions of the bus electrode 4 within a range which does not cause any problem on the function of the bus electrode 4 and the like. Of course, in this case, it is preferable that the vertical portions of the bus electrode 4 are disposed at the location of the isolation walls 6.

In the third embodiment, since only one bus electrode 4 is used in each of the center slit surface discharge electrodes 20, light emitted from fluorescent substances 9 is hardly obstructed by the center slit surface discharge electrodes 20, when compared with the structure of the first embodiment in which two bus electrodes 4 are used in each of the center slit surface discharge electrodes 20. Therefore, in the third embodiment, it is possible to realize a high luminance. Of course, the bus electrodes 4 having serpentine shape can be easily fabricated by using a photolithography technique, and the like.

[Embodiment 4]

Figure 4:
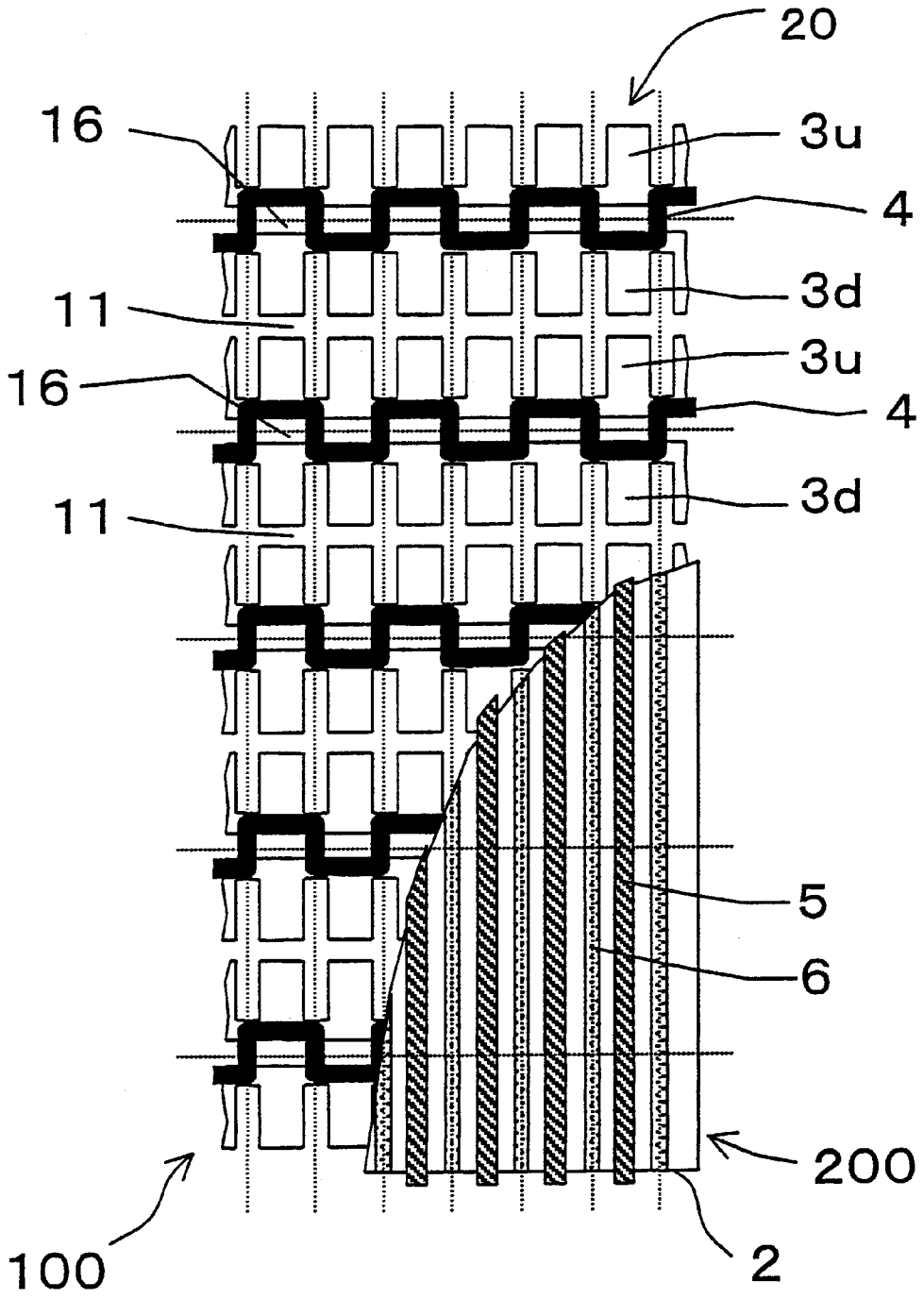
FIG. 4 is an elevational view illustrating an electrode structure of a plasma display panel according to a fourth embodiment of the present invention in which a portion of a rear substrate is cut away.

FIG. 4 illustrates a panel structure of a plasma display panel according to a fourth embodiment of the present invention. In FIG. 4, a structure of surface discharge electrodes of a front substrate 100 is shown in detail and a portion of a rear substrate 200 is cut away. The plasma display panel of FIG. 4 is the same as the plasma display panel of FIG. 3, except the structure of transparent electrode portions 3*u* and 3*d.* Each of the transparent electrode portions 3*u* and 3*d* has approximately comb like shape. Each of the bus electrodes 4 has a serpentine shape which is similar to the shape of the bus electrode 4 of the third embodiment.

In addition to the advantages of the third embodiment, according to the fourth embodiment, it is possible to decrease capacitance between adjacent transparent electrode portions 3*u* and 3*d* and to reduce discharge in the proximity of the isolation walls 6. Thereby, luminous efficiency can be improved.

[Embodiments 5 and 6]

Figure 5:
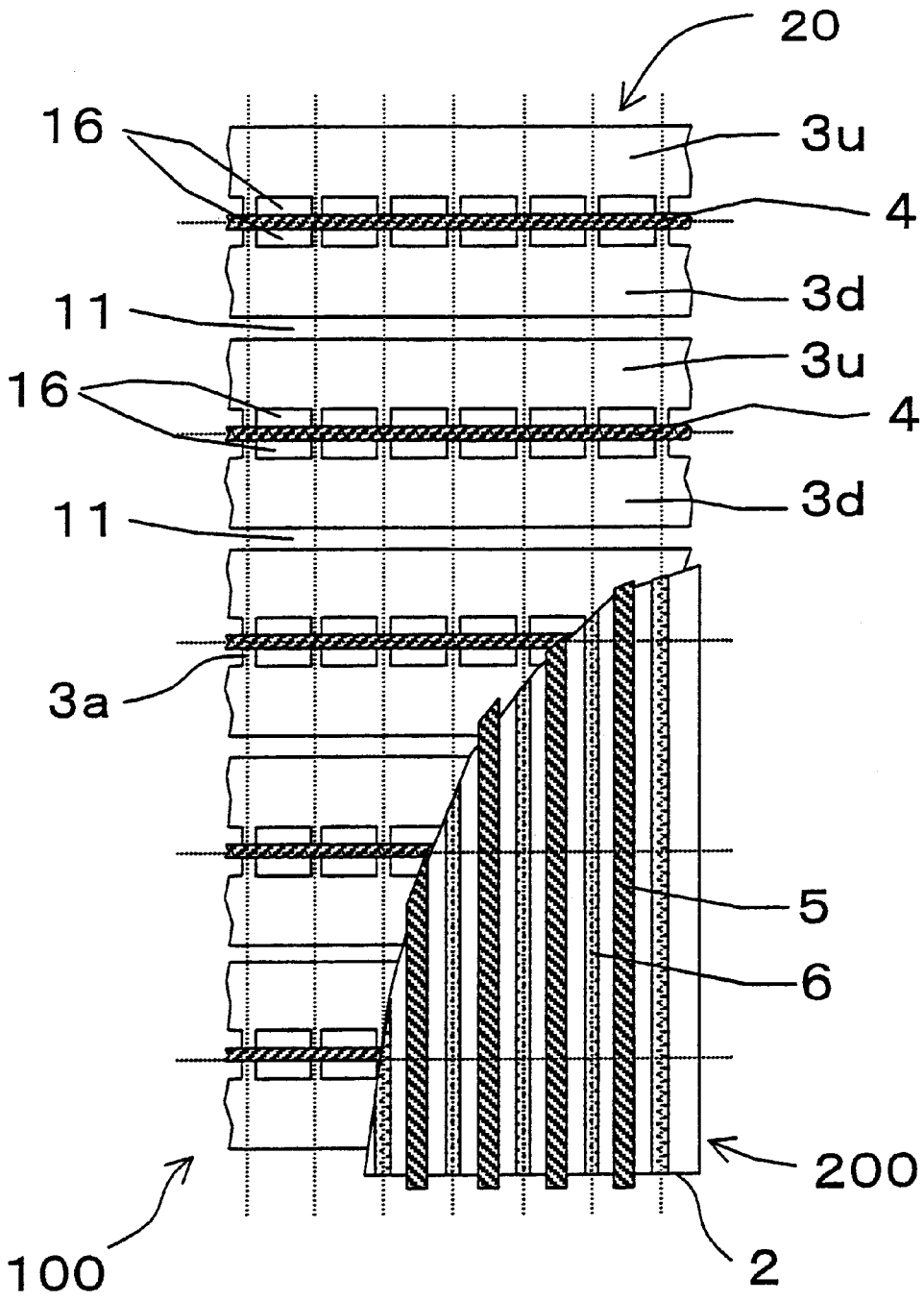
FIG. 5 is an elevational view illustrating an electrode structure of a plasma display panel according to a fifth embodiment of the present invention in which a portion of a rear substrate is cut away.
Figure 6:
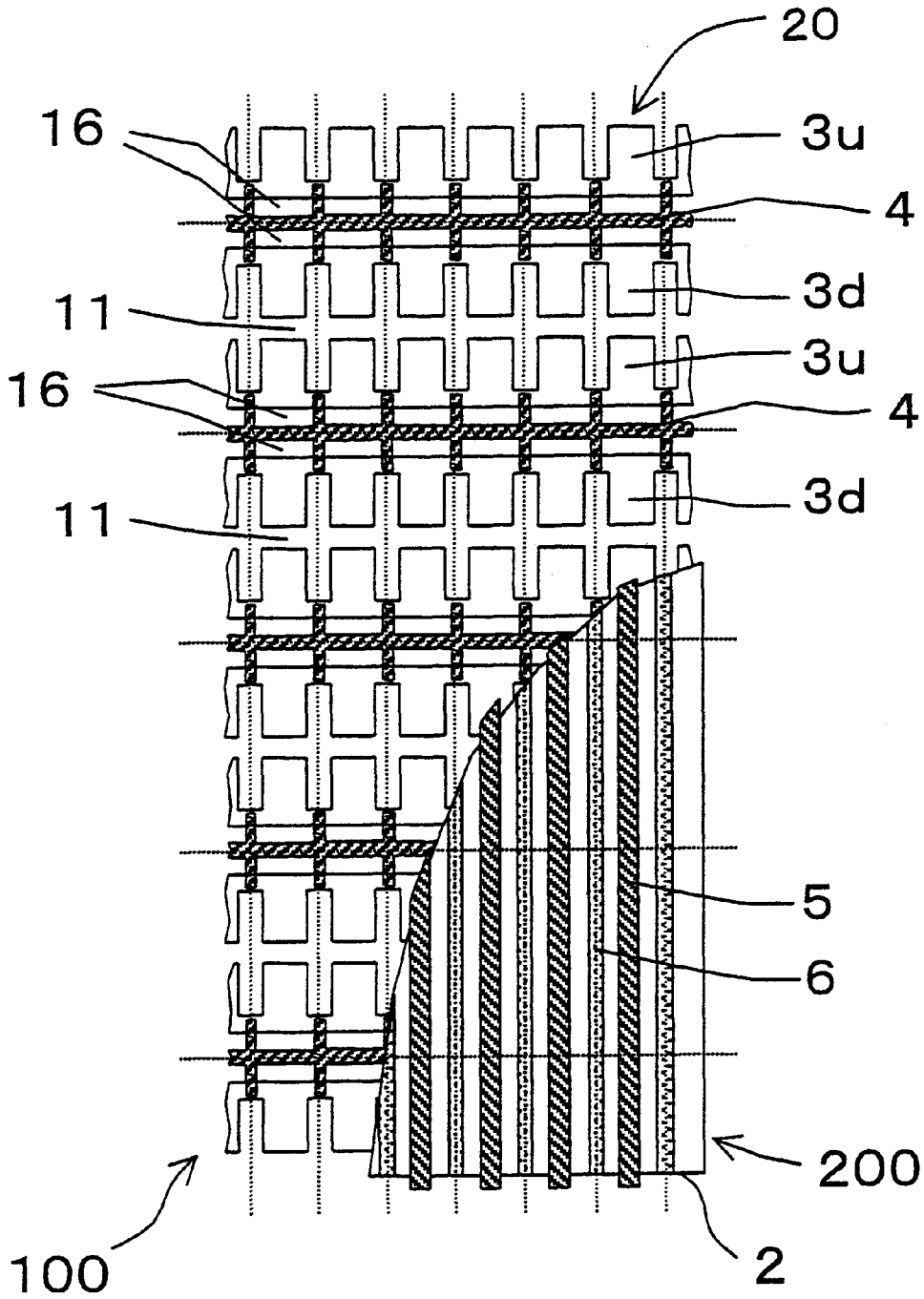
FIG. 6 is an elevational view illustrating an electrode structure of a plasma display panel according to a sixth embodiment of the present invention in which a portion of a rear substrate is cut away.

FIG. 5 and FIG. 6 illustrate panel structures of plasma display panels according to a fifth embodiment and a sixth embodiment of the present invention, respectively. In each of these drawings, a structure of surface discharge electrodes of a front substrate 100 is shown in detail and a portion of a rear substrate 200 is cut away. The plasma display panel of FIG. 2 is the same as the plasma display panel of FIG. 1, except the structure of surface discharge electrodes.

In the fifth embodiment shown in FIG. 5, transparent electrode portions 3*u* and 3*d* are band shaped electrodes which are electrically coupled via coupling portions 3*a* disposed at locations corresponding to isolation walls 6. At the central portion between the upper transparent electrode portion 3*u* and the lower transparent electrode portion 3*d,* there is disposed a bus electrode 4 which has a band shape and which is electrically coupled with the coupling portions 3*a* of the transparent electrode.

In the sixth embodiment shown in FIG. 6, each of an upper transparent electrode portion 3*u* and a lower transparent electrode portion 3*d* has a comb like shape having gaps disposed at locations corresponding to isolation walls 6. Also, in a center slit 16 between the transparent electrode portions 3*u* and 3*d,* there is disposed a bus electrode 4 of a fishbone shape having branch portions on both sides. The transparent electrode portions 3*u* and 3*d* are electrically coupled via the branch portions of the bus electrode 4.

In the fifth and sixth embodiments, since each of the bus electrodes 4 is disposed at the center of the center slit 16 where luminance of light emission is low, it is possible to improve luminance of displayed image.

Here, an explanation will be made on a function of the center slit 16. When AC pulses are applied between electrodes which are opposed to each other via the surface discharge gap 11 and retaining discharge is produced, it is necessary to retain the retaining discharge, while preventing the retaining discharge from spreading throughout the center slit surface discharge electrode 20 via the center slit 16. The center slit 16 prevent the retaining discharge from spreading throughout the center slit surface discharge electrodes 20. When the width of the center slit 16 is very narrow, it is impossible to separate the retaining discharge at the center slit 16. Therefore, it is necessary that the width of the center slit 16 is sufficiently wide. A required width of the center slit 16 depends on the composition of a discharge gas used, pressure of the discharge gas, drive conditions such as potential voltage of a retaining pulse and the like, thickness of the dielectric layer 7 used, the pitch of the isolation walls 6 and so on. Usually, in order to secure a stable discharge separation characteristic, it is preferable to make the width of the center slit 16 to be equal to or larger than approximately 60 microns.

In case of a large area panel, it is better to have some margin for the width, because it is difficult to obtain a uniform discharge characteristic throughout the whole surface of the panel and drive voltage pulses applied to the panel are also distorted by a load such as a capacitive load and the like of the panel. For example, in the panel structure shown in FIG. 3, when a pitch of pixels was 700 microns, the width of the surface discharge gap 11 was 80 microns, and the width of the center slit 16 was 120 microns. In this panel, the retaining discharge did not spread beyond the center slit 16, within a memory margin of the retaining pulses.

In the electrode structures of FIG. 5 and FIG. 6, the bus electrode 4 is formed in the center slit 16 and, therefore, the width of the center slit 16 is decreased by the width of the bus electrode 4. As a result, there is a possibility that retaining discharge spreads across the center slit 16 via the bus electrode 4 formed therein. Therefore, it is sometimes preferable to make the width of the center slit 16 of each of the plasma display panels of FIG. 5 and FIG. 6 wider than that of the center slit 16 of the plasma display panel of, for example, FIG. 3.

[Embodiment 7]

Figure 7:
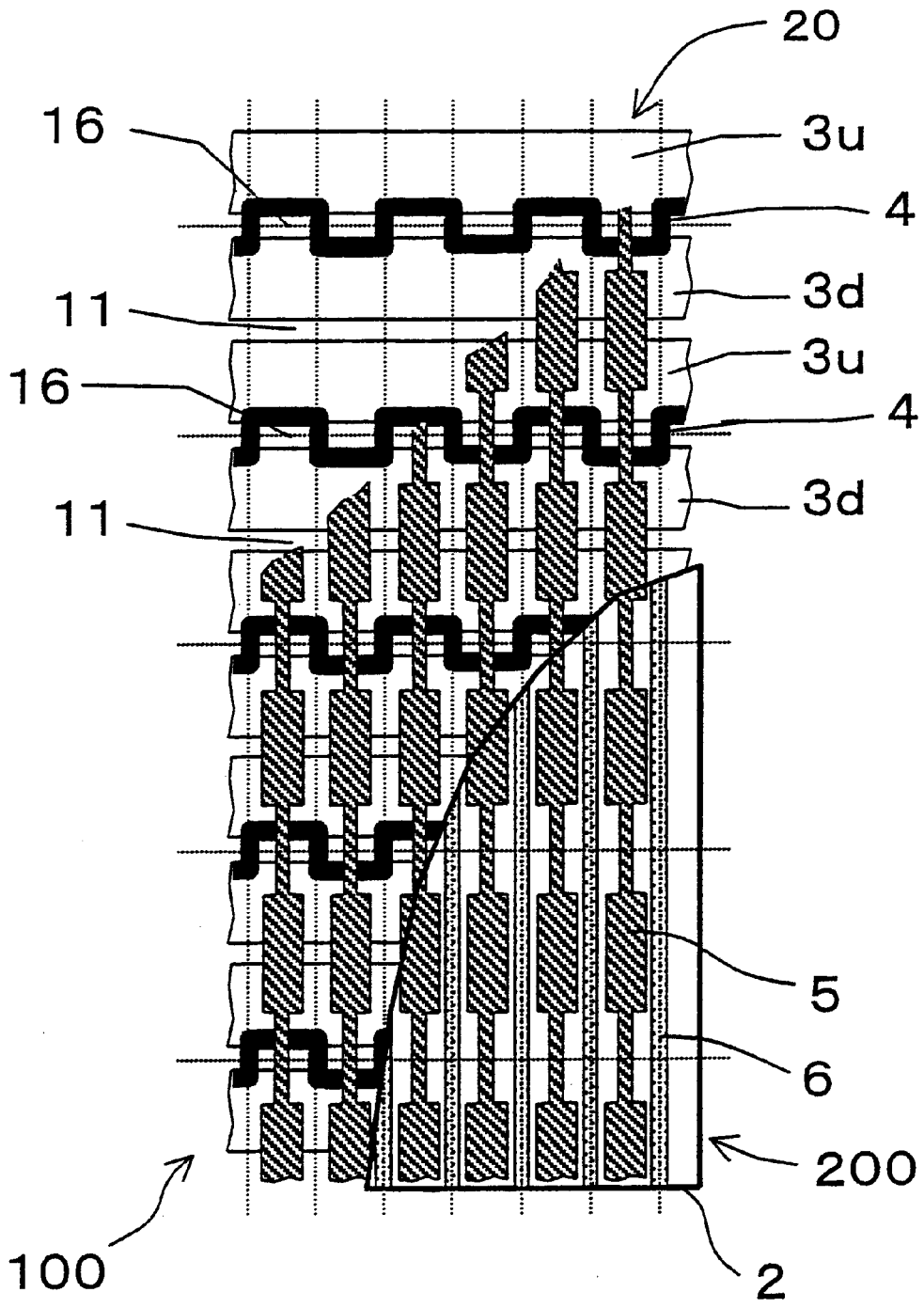
FIG. 7 is an elevational view illustrating an electrode structure of a plasma display panel according to a seventh embodiment of the present invention in which a portion of a rear substrate is cut away.

FIG. 7 illustrates a panel structure of a plasma display panel according to a seventh embodiment of the present invention. In FIG. 7, a structure of surface discharge electrodes of a front substrate 100 is shown in detail and a portion of a rear substrate 200 is cut away. The plasma display panel of FIG. 7 is the same as the plasma display panel of FIG. 3, except the structure of a rear substrate 200.

That is, a front substrate 100 is the same as that of FIG. 3, and comprises many center slit surface discharge electrodes 20 each comprising an upper transparent electrode portion 3*u* and a lower transparent electrode portion 3*d.* The upper transparent electrode 3*u* and the lower transparent electrode 3*d* are band shaped electrodes and are disposed parallel to each other via a center slit 16. Each of bus electrodes 4 has a serpentine shape.

In the rear substrate 200, each of the data electrodes 5 has wide portions facing portions of the front substrate 100 in the vicinity of the surface discharge gap 11 and has narrow portions facing portions of the front substrate 100 in the vicinity of the center gap 16. By using such structure, when data write operation is performed, an opposing discharge between the data electrode 5 and the surface discharge electrodes easily occurs in the vicinity of the surface discharge gap 11. Therefore, reliable write operation can be performed, so that it becomes possible to increase a drive margin and to decrease the magnitude of data voltage signal. Also, by using such data electrode shape, it is possible to suppress a possibility of occurrence of an opposing discharge between the bus electrode 4 and the data electrode 5. When the bus electrode 4 has the serpentine shape as shown in FIG. 7, portions of the bus electrode 4 come up and down. In this case, if the opposing discharge occurs easily between the bus electrode 4 and the data electrode 5 in the write operation, it becomes impossible to attain high quality display operation. Thus, the shape of the data electrode 5 of this embodiment is quite advantageous to obviate such problem.

[Embodiment 8]

Figure 8:
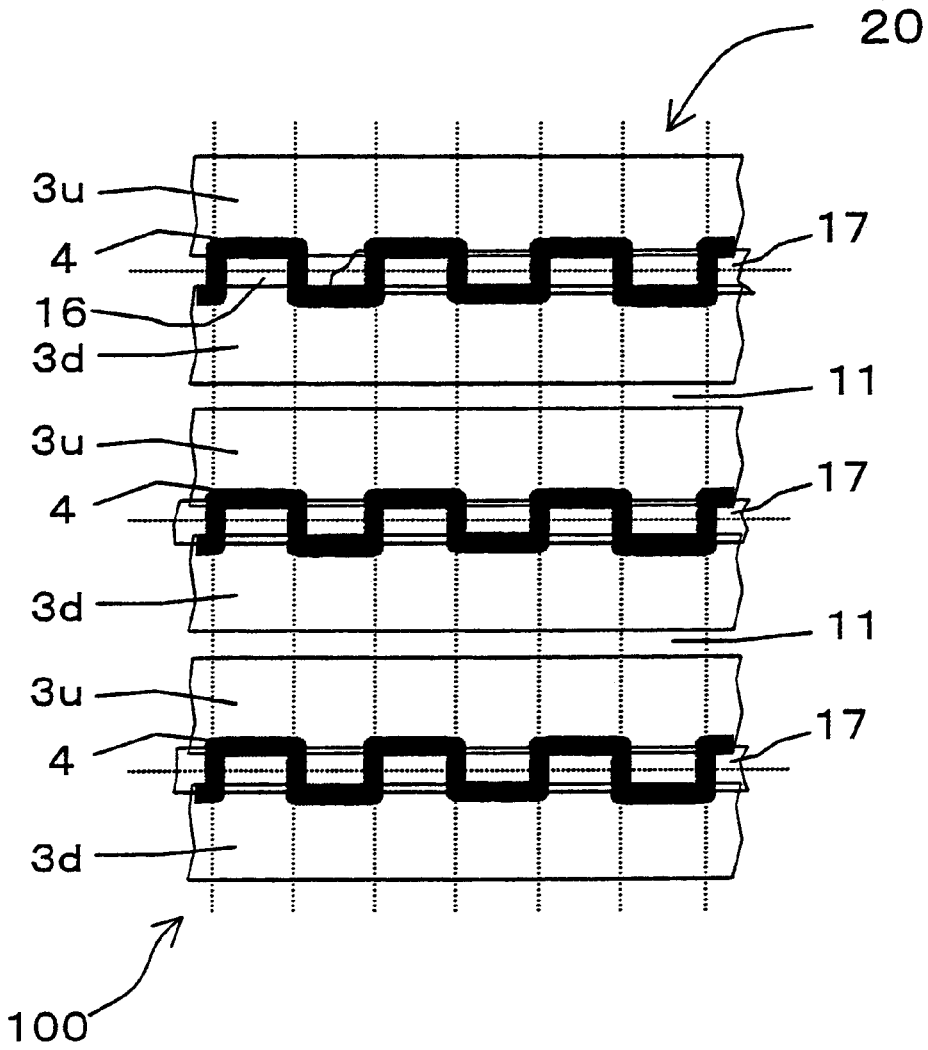
FIG. 8 is an elevational view illustrating an electrode structure of a plasma display panel according to an eighth embodiment of the present invention in which a portion of a rear substrate is cut away.

FIG. 8 illustrates a panel structure of a plasma display panel according to an eighth embodiment of the present invention. In FIG. 8, only a structure of surface discharge electrodes of a front substrate 100 is shown, and illustration of a rear substrate 200 is omitted. The plasma display panel of FIG. 8 is the same as the plasma display panel of FIG. 3, except that a colored layer 17 is provided at the central portion of each of center slit surface discharge electrodes 20, that is, at each of center slit portions 16. Each of transparent electrode portions 3*u* and 3*d* has a band like shape. Each of bus electrodes 4 has a serpentine shape which is similar to the shape of the bus electrode 4 of the third embodiment.

The portion of the center slit 16 is a portion having the lowest luminance in a distribution of light emission by the retaining discharge within a cell. Therefore, by forming a structure, which is colored, for example, black by including inorganic pigment powder, at the center slit portion 16, it is possible to lower reflectance of the panel and to improve contrast at relatively high luminance portions of a displayed image. In order to improve contrast at relatively high luminance portions, it is preferable to form the colored layer 17 on a glass substrate 1 (FIG. 16B) before forming the bus electrodes 4 and the like. However, it is also possible to form the colored layer 17 on or under a protective layer 8 (FIG. 16B).

In the above, various embodiments of the plasma display panels are described mainly on the structures and shapes of center slit surface discharge electrodes, and also on the structure combined with the data electrodes and the colored layers 17.

Hereafter, description will be made on various methods of displaying an image by the plasma display panel described above, in which various suitable methods of driving the plasma display panel are used.

[Method 1]

Figure 9A:
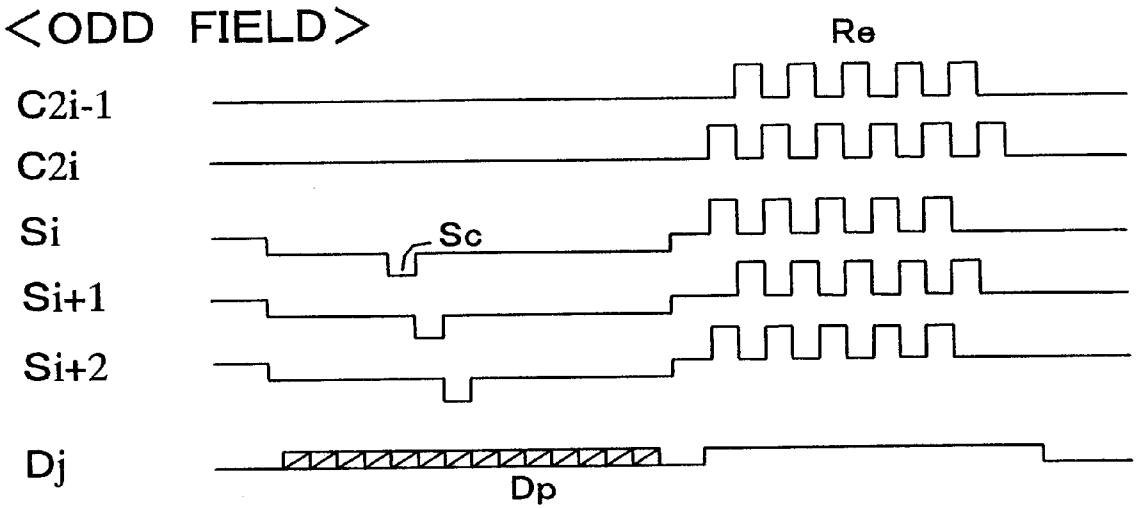
FIG. 9A and FIG. 9B are waveform diagrams showing drive signals used for explaining a method of driving a plasma display panel according to the present invention.
Figure 9B:
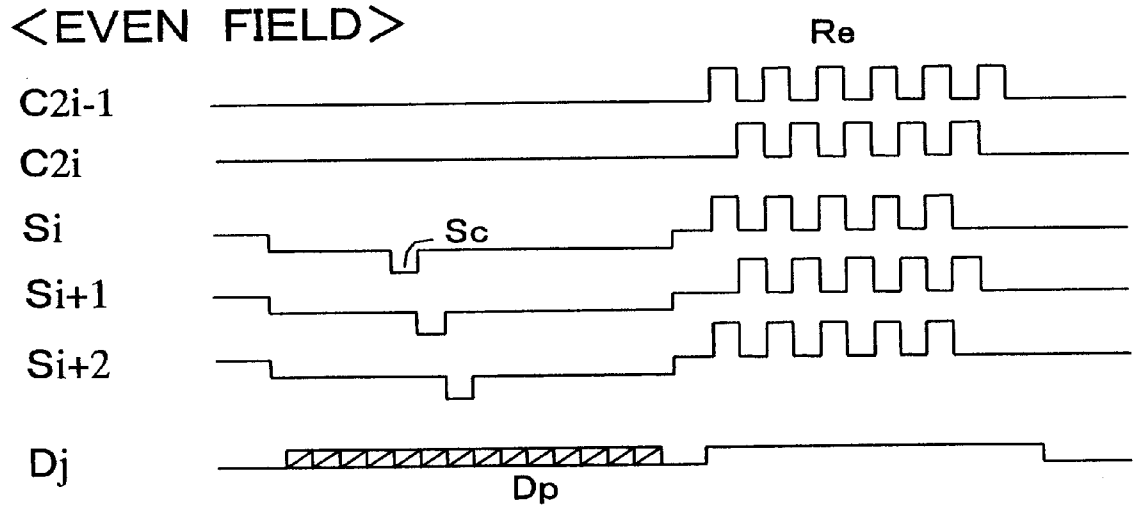

FIG. 9A and FIG. 9B show waveforms of drive signals applied to the various electrodes of the plasma display panel, for example, of the third embodiment mentioned above, in an odd number field and an even number field. Also, FIG. 10A and FIG. 10B illustrate discharge operation of various electrodes in an odd number field and an even number field, respectively.

The center slit surface discharge electrodes 20 are grouped into S electrodes and C electrodes. These electrodes are disposed in order of C1, S1, C2, S2, . . . , Ci, Si, Ci+1, Si+1, Ci+1, . . . , Cn, Sn. A scanning driver IC (Integrated Circuit) not shown in the drawing is connected to each of the S electrodes. The C electrodes are divided into a group of odd number of C electrodes and a group of even number of C electrodes. The C electrodes of each group are coupled together. FIG. 9A and FIG. 9B show waveforms of drive signals applied to the group of the C electrodes of odd numbers (C1, C3, . . . C2i−1, . . . ), the group of the C electrodes of even numbers (C2, C4, . . . , C2i, . . . ), the S electrodes which are scanned and driven by the scanning driver IC, and the data electrodes 5 (Dj), in a write period and in a retaining period.

First, in the write period, opposing discharges are produced by scanning pulses and data pulses. As shown in FIG. 10A, at a time a scanning pulse is applied to the Si electrode, data pulses are applied to the data electrode (Dj) and the data electrode (Dj+1) ( ). Thereby, opposing discharge occurs between the data electrode 5 and the Si electrodes, that is, between the data electrode 5 and an upper electrode portion SUi of a center slit surface discharge electrode 20 and between the data electrode 5 and a lower electrode portion SDi of the center slit surface discharge electrode 20. Also, surface discharge occurs between the SUi electrode portion and the CDi electrode portion, and between the SDi electrode portion and the CUi+1 electrode portion, thereby plenty of wall charges are stored on these surface discharge electrodes. Such write operation is performed throughout the whole surface of the panel depending on data for display.

Figure 10A:
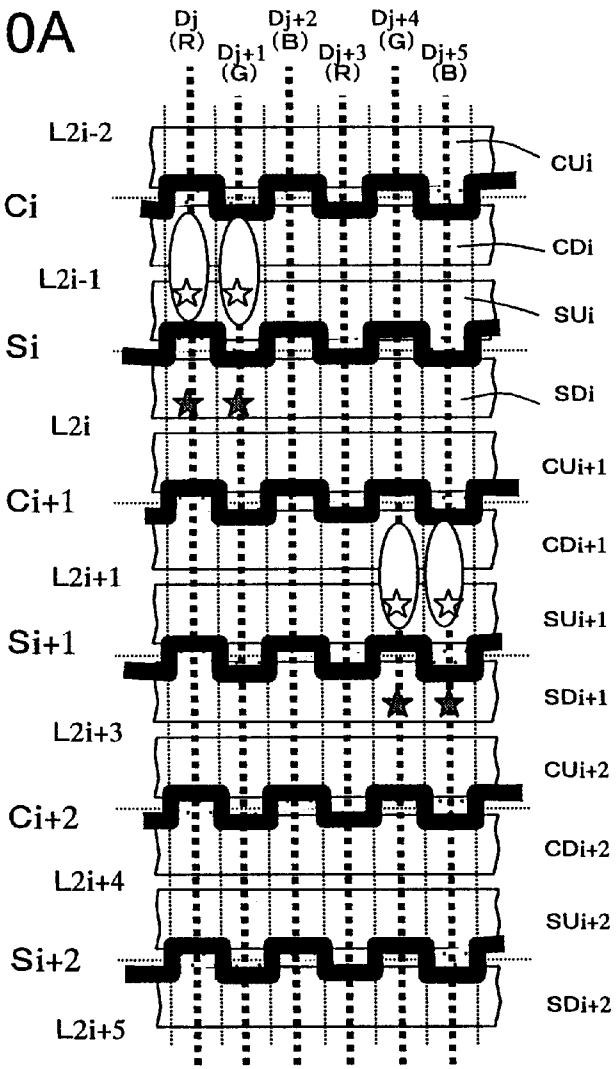
FIG. 10A and FIG. 10B are elevational views illustrating discharge operation of a plasma display panel driven by the drive signals shown in FIG. 9A and FIG. 9B.
Figure 10B:
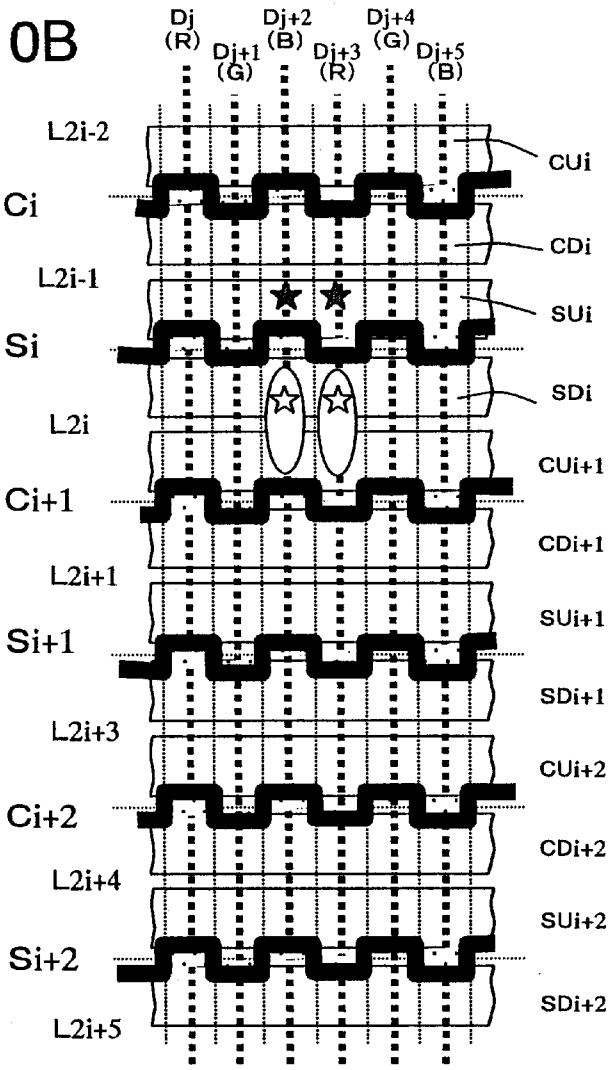

FIG. 10A shows a situation in which the data electrodes 5 (Dj+4, Dj+5) are further written at the time the Si+1 electrode is scanned. After the write operation of all the S electrodes is finished by applying scanning pulses to the electrodes S1 through Sn, retaining pulses are supplied during the retaining period and display of image and the like is performed by light emission. Phases of the retaining pulses differ by a half pitch between the C electrodes of odd numbers and of even numbers. Also, phases of the retaining pulses differ by a half pitch between the S electrodes of odd numbers and of even numbers. In this embodiment, the phases of the retaining pulses are in phase between the C electrodes of odd numbers and the S electrodes of even numbers, and are in phase between the C electrodes of the C electrodes of even number and the S electrodes of odd numbers. The phases of the retaining pulses differ by a half pitch between these groups of electrodes, for example, between the C electrodes of odd numbers and the C electrodes of even numbers. Therefore, AC pulses are applied between these groups of electrodes. That is, when considered from each S electrode, one of the C electrodes which are adjacent to the S electrode and which are on the upside and on the downside of the S electrode is in phase, and the other C electrode is in opposite phase. In FIG. 10, when considered from each S electrode, the C electrode which is adjacent to the S electrode and which is on the upper side of the S electrode is in opposite phase, and the C electrode which is adjacent to the S electrode and which is on the lower side of the S electrode is in phase.

By the application of these retaining pulses, a written-in condition is realized in which wall chares are formed both on the upper side and lower side of each S electrode. However, only on one side of the center slit surface discharge electrode 20, the retaining discharge is produced by the application of the retaining pulses and display by light emission is performed. That is, the retaining discharge occurs only between the SUi electrode portion on the upper side of the Si electrode and the CDi electrode portion on the lower side of the Ci electrode. Although wall charges are formed on the SDi electrode portion on the lower side of the Si electrode, retaining discharge does not occur on the SDi electrode portion. This is because the phase of the retaining pulses applied to the SDi electrode portion and the phase of the retaining pulses applied to the adjacent CUi+1 electrode portion are in phase.

According to the sequence mentioned above, display by light emission is performed at every other pixel row. In the above description with reference to FIG. 9 and FIG. 10, pixel rows of odd numbers perform display by light emission in the field of odd numbers. Next, display operation is performed at the pixel rows of even numbers in the field of even number in a manner similar to the display operation in the odd field mentioned above. The display operation and signal waveforms in the even field differ from those in the odd field in that, in the even field, the phases of the retaining pulses are in phase between the C electrodes of odd numbers and the S electrodes of odd numbers and are in phase between the C electrodes of even numbers and the S electrodes of even numbers. Also, the phases of the retaining pulses differ by a half pitch between these groups of electrodes, for example, between the C electrodes of odd numbers and the C electrodes of even numbers. By such phase relation of the retaining pulses, the retaining discharge occurs between the lower portion of the S electrode and the upper portion of the C electrode, and pixels at rows of even numbers perform display operation by light emission. In this way, in two fields including an odd field and an even field, pixels of a whole picture are displayed by light emission.

Figure 11A:
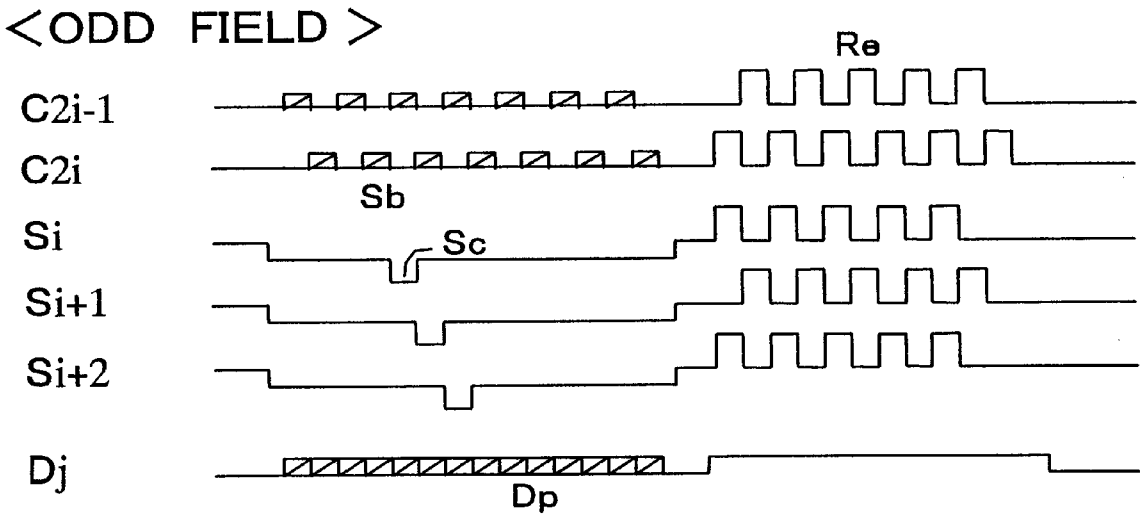
FIG. 11A and FIG. 11B are waveform diagrams showing other drive signals used for explaining a method of driving a plasma display panel according to the present invention.
Figure 11B:
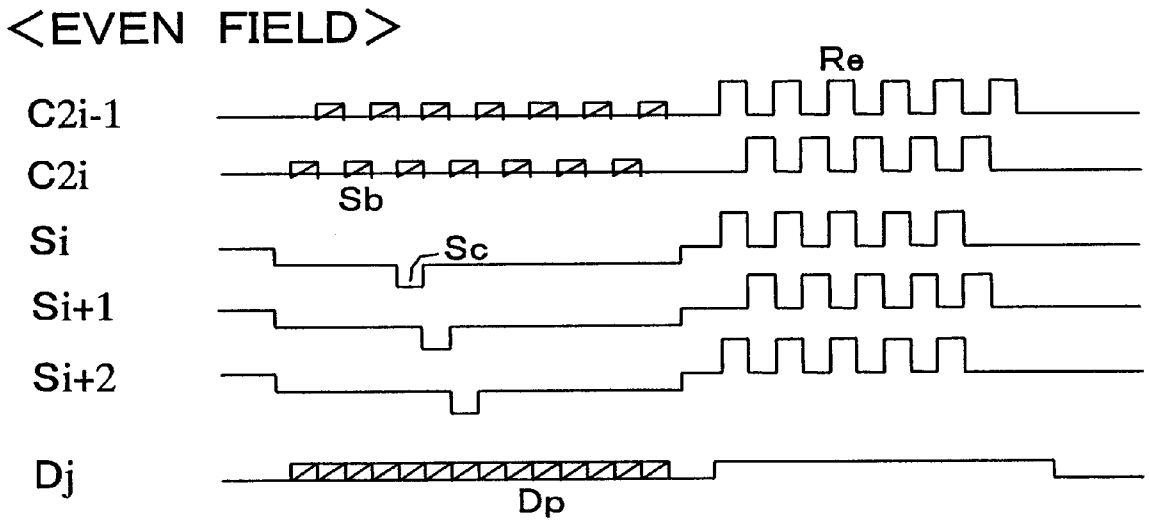

In the above-mentioned first method of display in the plasma display panel, it is possible to apply sub-scanning pulses Sb to the C electrodes as shown in FIG. 11A and FIG. 11B, in order to improve erroneous writing or faulty writing to increase drive margin. The sub-scanning pulses Sb are out of phase between the C electrodes of odd number and the C electrodes of even number, and intensity of surface discharge which is caused by an opposing discharge between the S electrode and the data electrode 5 as a trigger is controlled, thereby write operation can be stabilized. That is, at a time a negative scanning pulse is applied to the S electrode, the potential of the C electrode which is adjacent to and on the upper side of the S electrode is made higher than the potential of the C electrode which is adjacent to and on the lower side of the S electrode. Thereby, it becomes possible to perform stronger write operation between the pixel rows which are to perform retaining light emission. In the even fields, the lower portion of the S electrode becomes a row performing display by light emission. Therefore, the phase of the sub-scanning pulses in the even field is reversed from that in the odd field, and at a time a negative scanning pulse is applied to the S electrode, the potential of the C electrode which is adjacent to and on the lower side of the S electrode is made higher than the potential of the C electrode which is adjacent to and on the upper side of the S electrode. In FIGS. 11A and 11B, the sub-scanning pulses Sb have, as an example, a positive polarity. However, when the potential voltage of the scanning pulses of the S electrodes is sufficiently high and is liable to cause erroneous writing, it is possible to use the sub-scanning pulses having negative polarity. In this case, the scanning pulses are applied such that the potential of the C electrode on the opposite side of the pixel rows emitting light for display becomes close to the potential of the S electrode.

In the above, drive operation of the plasma display panel was described concerning only on the write operation and the retaining operation. In order to properly perform the drive operation of the AC type plasma display panel, it is necessary to apply signals for erasure discharge and preliminary discharge before performing the write operation. However, these signals are not directly concerned with the essential portion of the present invention and, therefore, description thereon is omitted here.

[Method 2]

Figure 12A:
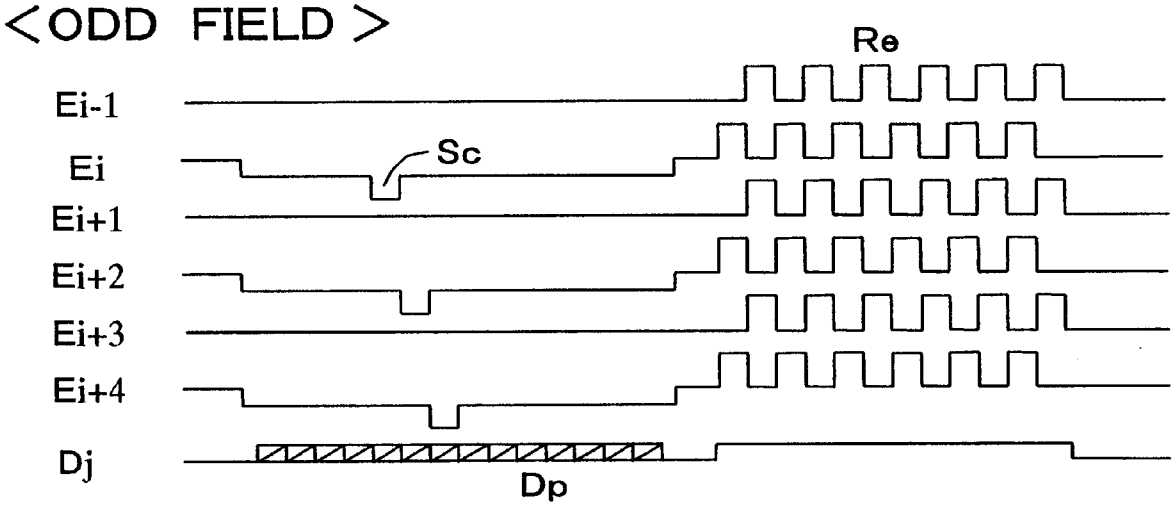
FIG. 12A and FIG. 12B are waveform diagrams showing still other drive signals used for explaining a method of driving a plasma display panel according to the present invention.
Figure 12B:
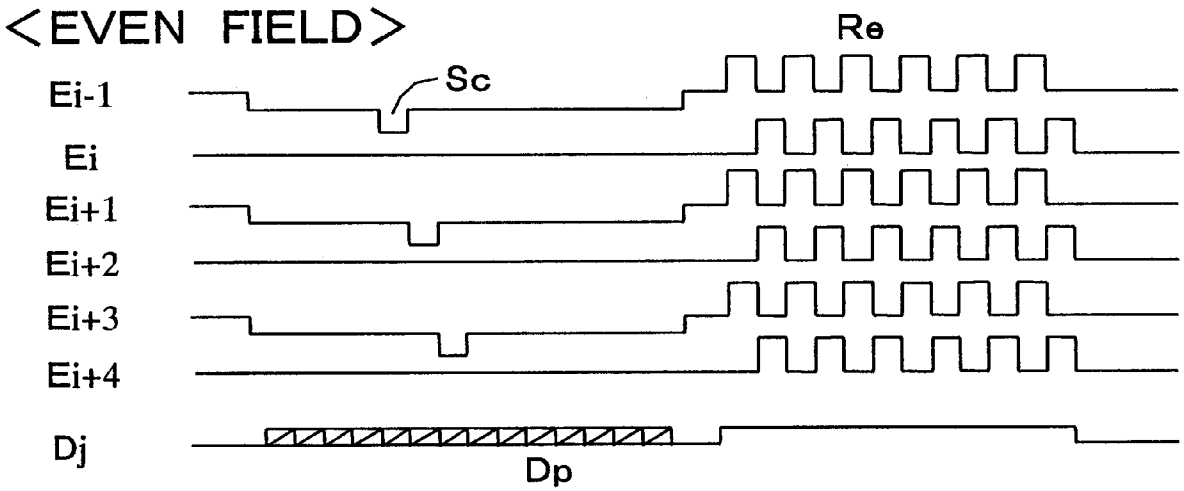
Figure 13B:
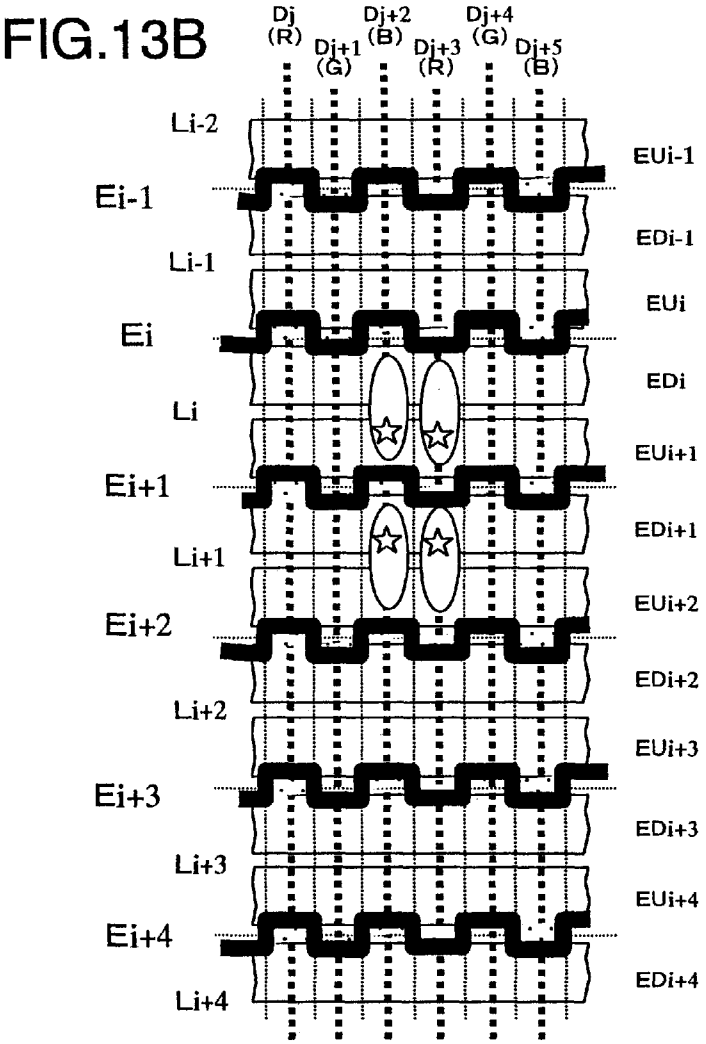
FIG. 13A and FIG. 13B are elevational views illustrating discharge operation of a plasma display panel driven by the drive signals shown in FIG. 12A and FIG. 12B.
Figure 13A:
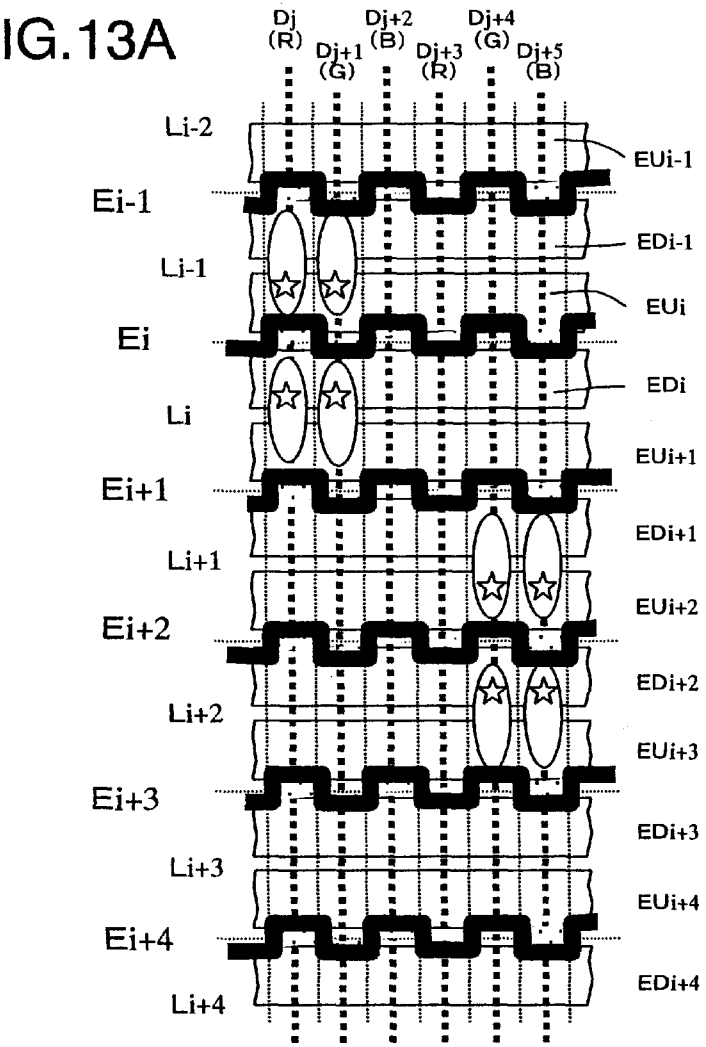

By using the plasma display panel of the third embodiment, which is the plasma display panel having center slit surface discharge electrodes, a second method of driving the plasma display panel will be described. In the second method, two adjacent pixel rows are driven as the rows displaying the same content. FIG. FIG. 12A and FIG. 12B show waveforms of drive signals applied to the various electrodes of the plasma display panel, in an odd number field and an even number field. Also, FIG. 13A and FIG. 13B illustrate discharge operation of various electrodes in an odd number field and an even number field, respectively.

In this method, differing from the first method of driving the plasma display panel, a scanning driver IC is connected to all the center slit surface discharge electrodes 20. Therefore, number of the electrodes is designated as Ei in the drawings.

First, in odd fields, scanning pulses are sequentially applied to the electrodes E of odd numbers, and write operation is performed in accordance with data to be displayed. In the example shown in FIG. 13A and FIG. 13B, at a time the scanning pulse is applied to the electrode Ei, data pulses are applied to a data electrode 5 (Dj) and a data electrode 5 (Dj+1). Then, at a time the scanning pulse is applied to the electrode Ei+2, data pulses are applied to a data electrode 5 (Dj+5) and a data electrode (Dj+6). By these write operation, opposing discharge occurs at portions shown by star marks between the electrodes E and the data electrodes 5. Triggered by these opposing discharge, surface discharge occurs between adjacent electrodes and sufficient wall charges are formed. Then, retaining pulses are supplied and, thereby, pixels into which data is written emit light to perform display. The retaining pulses are supplied during the retaining period and display of image and the like is performed by light emission. Phases of the retaining pulses differ by a half pitch between the electrodes of odd numbers and of even numbers. Thereby, the retaining discharge occurs simultaneously between the EUi electrode portion on the upper side of the Ei electrode and the EDi−1 electrode portion on the lower side of the Ei−1 electrode and between the EDi electrode portion on the lower side of the Ei electrode and the EUi+1 electrode portion on the upper side of the Ei+1 electrode. As a result, two pixel rows on the upper side and on the lower side of the electrode Ei, i.e., a pixel row Li−1 and a pixel row Li, have the same condition of display by light emission. With respect to the electrode Ei+2, write operation and display operation are performed in a manner similar to those of the electrode Ei. In the even field, scanning pulses are applied to the center slit surface discharge electrodes 20 of even numbers, and write operation is performed in accordance with the data to be displayed. In the odd field, by the retaining pulses applied thereafter, two pixel rows including each pixel row to be displayed in the odd field and one adjacent pixel row become the same condition of display.

The differences between the first method and the second method are as follows. Both methods use an interlaced display system in which odd field and even field are sequentially displayed. However, in the first method, display by retained light emission is performed every other row and independently row by row. In the second method, two pixel rows perform display by retained light emission by using the same data. Therefore, in the second method, although a resolution may be somewhat decreased, it is possible to alleviate visual disturbance of scanning lines caused by interlaced drive. Also, in the second method, since light emission by the application of the retaining pulses is performed in all the pixel rows, it is possible to obtain a higher luminance of display than in the first method. On the other hand, in the second method, it is necessary to couple the scanning driver circuits to all the center slit surface discharge electrodes 20, except one row in the top row and one row in the bottom row. However, in the first method, the number of the scanning driver circuits can be only a half of the number of the center slit surface discharge electrodes 20, and therefore it is possible to reduce manufacturing costs.

Figure 14A:
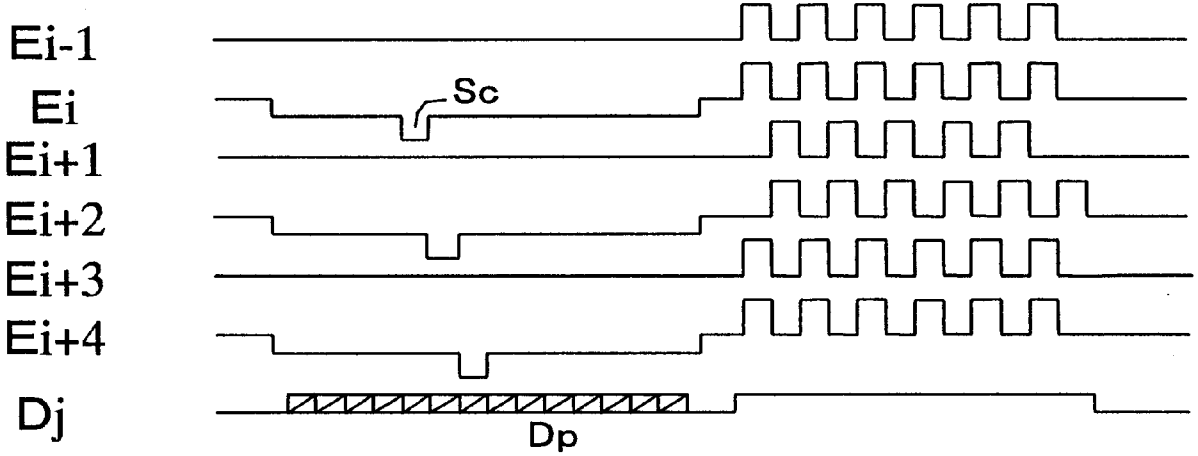
FIG. 14A and FIG. 14B are waveform diagrams showing still other drive signals used for explaining a method of driving a plasma display panel according to the present invention.
Figure 14B:
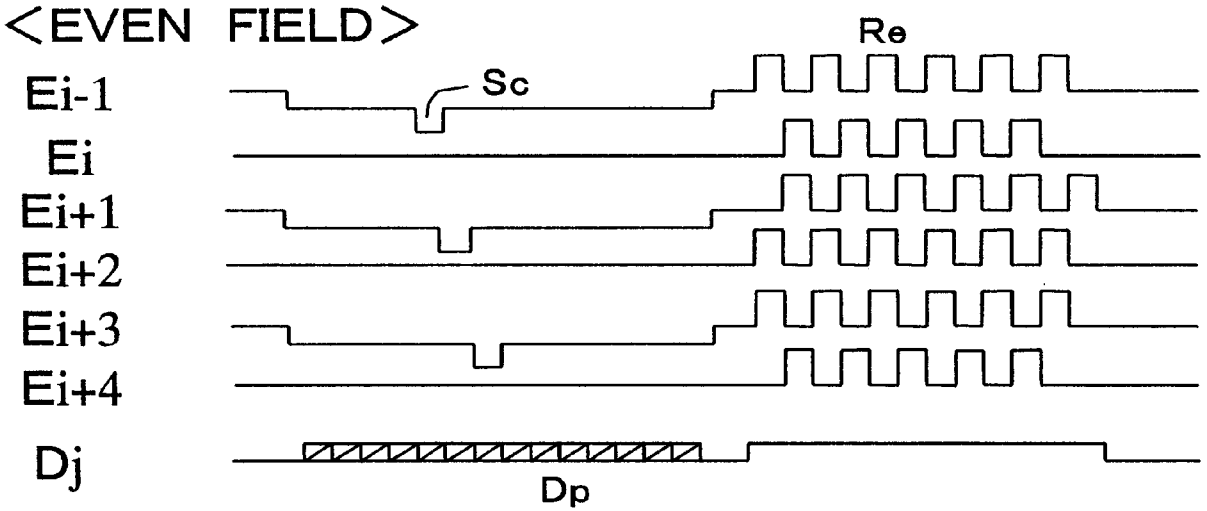

It should be noted that, in the plasma display panel which is designed to perform display according to the second method and in which the scanning driver circuits are coupled to all the center slit surface discharge electrodes 20 except the top and bottom rows, it is also possible to perform display drive in accordance with the first method. For example, it is possible to drive such plasma display panel by using the signal waveforms as shown in FIGS. 11A and 11B or in FIGS. 12A and 12B. Also, as shown in FIGS. 14A and 14B, it is possible to apply scanning pulses to the surface discharge electrodes of the odd rows in an odd field to perform write operation, and to make phases of retaining pulses in phase and reverse phase every second rows, thereby performing display row by row.

[Method 3]

Therefore, as a third method, it is possible to switch the drive method from external, or to automatically switch the drive method according to an input signal. For example, when the input signal is a video signal such as a video signal from a television broadcast, the second method is used to perform display by the retained light emission of two rows, and when the input signal is a signal for performing display of information for a personal computer and the like, it is possible to use display by the retained light emission of one row. In the third method, when a picture from, for example, the television broadcast, it is possible to display a smooth picture without visual line disturbance and having a high luminance, and when the computer information is displayed, it is possible to display an image and the like in which each pixel is clearly displayed and which has a high resolution, although luminance is somewhat decreased.

The reason why the above-mentioned display operation can be performed is because there is provided a center slit 16 in each surface discharge electrode whose electrode portions have substantially the same potential, and the retained discharge does not pass across the center slit 16 and does not spread to the electrode portion having the same potential on the opposite side. Also, in the above description on methods of driving the plasma display panel, the structure shown in FIG. 3 is used as an example. However, it is possible to use other structures. In the plasma display panel which uses center slit surface discharge electrodes 20 each having a center slit 16, it is possible to change shape of each electrode and/or of each center slit surface discharge electrode, if, for example, width and/or shape of the center slit are determined such that the retaining discharge does not pass across the center slit.

Also, in the above explanation, a designation of the odd number or the even number, a designation of upper side or lower side, and so on are used only by way of example. It is not always necessary to use the structures mentioned above, if the keystone of the present invention is satisfied and matching of sequential order of components is considered. With respect to the methods of driving the plasma display panel, explanation has been made on a system in which write period and retaining period are separated. However, the present invention is also applicable to a system in which the write period and the retaining period are mixed.

Figures 15A, 15B, 15C, 15D:
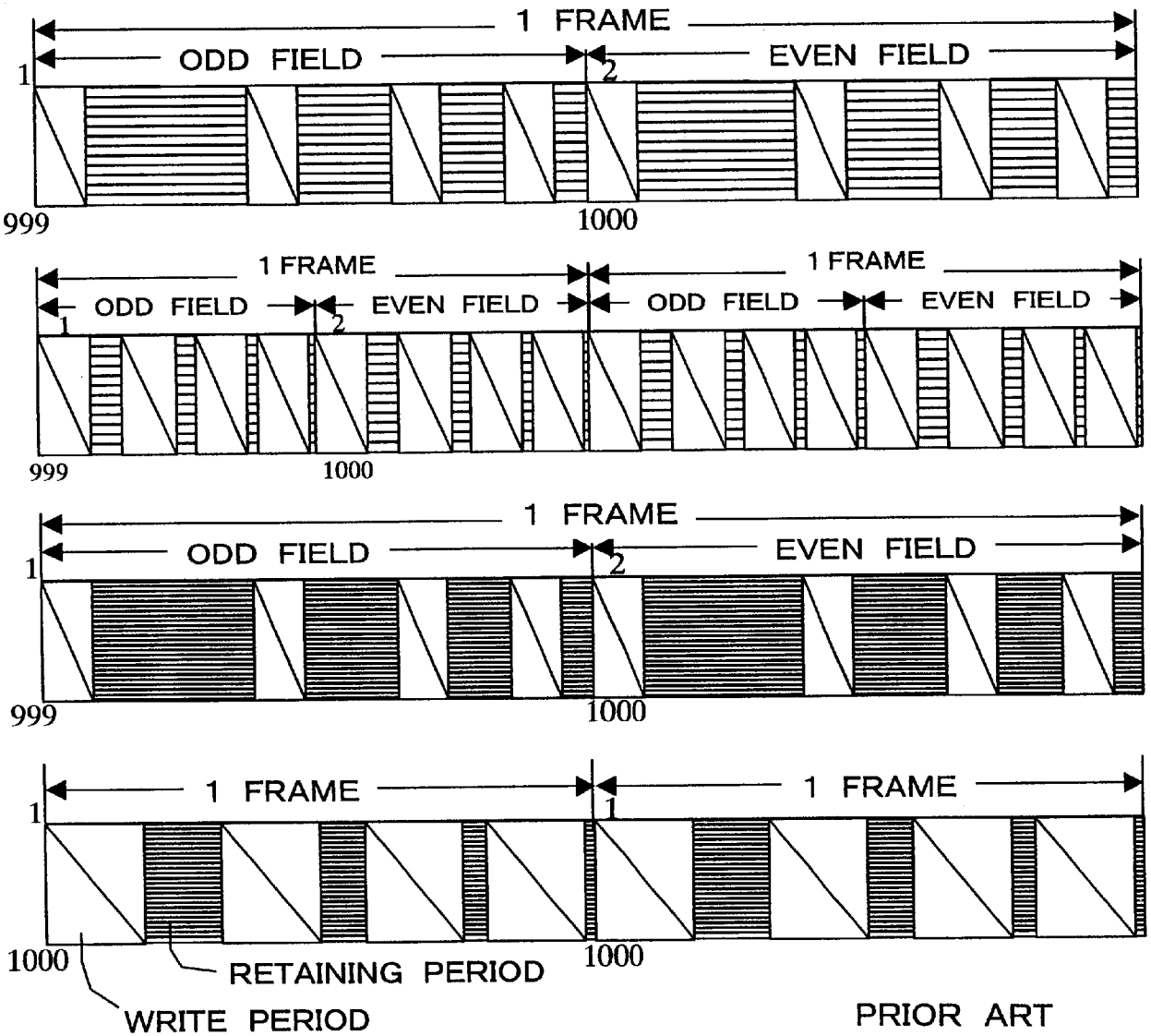
FIG. 15A, FIG. 15B, FIG. 15C and FIG. 15D are timing diagrams illustrating frame sequences of display operation of a plasma display panel according to the present invention and of a conventional plasma display panel.

Further, in the above, methods of driving the plasma display panel have been explained mainly on the methods of driving the plasma display panel using the center slit surface discharge electrodes 20. However, in order to perform full color display by the plasma display panel, it is important to use an appropriate sub-field structure. FIGS. 15A through 15C illustrate sub-field structures applicable to the plasma display panels according to the present invention. Also, FIG. 15D illustrates a sub-field structure of a conventional plasma display panel for comparison. One frame is composed of a plurality of sub-fields. One frame corresponds to approximately one 60th (1/60) second in an NTSC standard television signal. FIGS. 15A through 15D show only 4 (four) sub-fields for the sake of simplicity. However, in practice, one field is composed of 8 sub-fields to perform display having 256 gradations. In FIG. 15A, FIG. 15B and FIG. 15C illustrating the sub-field structures in frames in the plasma display panel according to the present invention, one frame is composed of two fields including an odd field and an even field, and, in each of the fields, display by using the sub-fields is performed.

FIG. 15A illustrates an example of a display sequence in the above-mentioned first method. An odd field of one 60 th second and an even field of one 60 th second are repeated. One frame having an odd field and an even field finishes in one 30 th second. Each rectangle with a diagonal shows a write period. Each rectangle with horizontal stripe shows a retaining period. In this sequence, light emission display by retained discharge is performed every second row. However, when compared with the conventional method shown in FIG. 15D, number of write operation becomes one half of that of the conventional method, and therefore this method can have enough time for retained discharge period and write period. As a result, it is possible to drive a high resolution panel at high luminance.

FIG. 15B illustrates an example in which driving is performed at double speed. In this example, each of an odd field and an even field is displayed in one 120 th second. The odd field and the even field are alternately repeated. This method is suitable for performing a display without causing surface flicker or line flicker when, for example, computer information and the like is displayed. Number of write operation is the same as that of the conventional method of FIG. 15D, and, therefore, temporal merit is not obtained. However, luminance can be raised because of the shape of the center slit surface discharge electrodes, and number of scanning drivers can be one half of that of the conventional plasma display panel.

FIG. 15C illustrates an example of a display sequence in the above-mentioned second method. Similarly to the display sequence of FIG. 15A, one frame comprises an odd field of one 60th second and an even field of one 60th second. One frame having an odd field and an even field finishes in one 30th second. Each field comprises a plurality of sub-fields for display of gradation. When compared with the conventional method shown in FIG. 15D, number of write operation becomes one half of that of the conventional method, and therefore this method can have enough time for retained discharge period and write period. Also, differing from those of FIG. 15A and FIG. 15B, in this method, retained light emission of the sub-fields is performed in all the pixel rows in the panel. As a result, it is possible to drive a plasma display panel at high luminance.

With respect to the third method mentioned above in which display condition can be switched between the retained light emission of two rows at the same time and the retained light emission of one row, it is possible to switch display sequences. For example, when the retained light emission of two rows is performed, the frame structure shown in FIG. 15C can be used, and when the retained light emission of one row is performed, the frame structure shown in FIG. 15B can be used. By this method, when a picture from, for example, the television broadcast is displayed, it is possible to display a picture having a high luminance, and when the computer information is displayed, it is possible to perform a display without causing a flicker and having a high resolution although a luminance is somewhat decreased.

In summary, according to the present invention described above, the structure of the center slit surface discharge electrodes provide a large proportion of an effective area of electrode contributing display operation in each of the discharge cells. Obstruction of light emission by the bus electrodes can be very small. It is possible to separate discharge on the upper side portion and on the lower side porton of the surface discharge electrode to which the same drive signal waveform is applied, without using isolation walls and the like which are difficult in manufacturing and which affect evacuation process and the like. By combining the panel structure according to the present invention with the above-mentioned drive methods, it is possible to raise luminance, to raise a resolution, and to improve drive characteristics in the plasma display panel and the display apparatus using such plasma display. Also, it is posible to lower the number of drive circuits and to reduce cost of the plasma display panel.

In the foregoing specification, the invention has been described with reference to specific embodiments. However, one of ordinary skill in the art appreciates that various modifications and changes can be made without departing from the scope of the present invention as set forth in the claims below. For example, in the above-mentioned plasma display panels and methods of driving the same, number, location, shape and the like of various components are not limited to those particularly shown above, and can be any number, location, shape and the like suitable for implementing the present invention. Accordingly, the specification and figures are to be regarded in an illustrative sense rather than a restrictive sense, and all such modifications are to be included within the scope of the present invention. Therefore, it is intended that this invention encompasses all of the variations and modifications as fall within the scope of the appended claims.

What is claimed is:

1. A plasma display panel comprising:

a plurality of center slit surface discharge electrodes extending in a first direction, each of said center slit surface discharge electrodes comprising a pair of adjacent surface discharge electrode portions and a center slit between said surface discharge electrode portions, a split bus electrode disposed over each one of said plurality of center slit surface discharge electrodes having one portion of said split bus electrode making electrical contact to one of said pair of adjacent surface discharge electrode portions, and another portion of said split bus electrode making electrical contact to the other one of said pair of adjacent surface discharge electrode portions;

a substantially straight linear surface discharge gap formed between adjacent ones of said plurality of center slit surface discharge electrodes; and a plurality of data electrodes extending in a second direction which crosses said first direction of extension of said center slit surface discharge electrodes;

wherein said portions of said split bus electrode make electrical contact with one another at locations only outside of a display area.

2. A plasma display panel as set forth in claim 1, wherein each of said data electrodes has wide portions in the proximity of said surface discharge gaps between adjacent said center slit surface discharge electrodes, and has narrow portions in the proximity of said center slits.

3. A plasma display panel as set forth in claim 1, wherein a colored layer is formed in the proximity of each of said center slits.

4. A plasma display panel as set forth in claim 1, wherein said center slit surface discharge electrodes are grouped alternately into S electrodes and C electrodes, a scanning driver for applying scanning pulses is connected to each of said S electrodes, and said C electrodes are grouped into a group of C electrodes of odd number and a group of C electrodes of even number, each of said groups of C electrodes being electrically coupled together.

5. A plasma display panel comprising:

a plurality of center slit surface discharge electrodes extending in a first direction, each of said center slit surface discharge electrodes comprising a pair of adjacent surface discharge electrode portions and a center slit between said surface discharge electrode portions;

a split bus electrode disposed over each one of said plurality of center slit surface discharge electrodes having one portion of said split bus electrode making electrical contact to one of said pair of adjacent surface discharge electrode portions, and another portion of said split bus electrode making electrical contact to the other one of said pair of adjacent surface discharge electrode portions;

surface discharge gaps each formed between adjacent ones of said plurality of center slit surface discharge electrodes; and a plurality of data electrodes extending in a second direction which crosses said first direction of extension of said center slit surface discharge electrodes, wherein each of said center slit surface discharge electrodes comprises said pair of surface discharge electrode portions which are formed of a pair of transparent electrodes and which are disposed parallel to each other via said center slit, and said split bus electrode electrically couples said pair of transparent electrodes with each other at locations disposed outside of a display area.

6. A plasma display panel as set forth in claim 5, further comprising isolation walls which are disposed parallel with said data electrodes and which define discharge spaces for display cells.

7. A plasma display panel as set forth in claim 5, wherein said bus electrode comprises a pair of elongated bus electrode portions which are disposed parallel to said center slit on said pair of transparent electrodes and which are mutually connected on both ends thereof at the locations outside said center slit surface discharge electrode, thereby said pair of said transparent electrodes are mutually electrically coupled via said bus electrode.

8. A method of driving a plasma display panel comprising:

providing a plurality of center slit surface discharge electrodes extending in a first direction, each of said center slit surface discharge electrodes having a pair of surface discharge electrode portions and a center slit between said surface discharge electrode portions;

providing a plurality of split bus electrodes, each being disposed over one of said plurality of center slit surface discharge electrodes and making electrical contact to respective ones of said center slit surface discharge electrodes;

providing a plurality of data electrodes extending in a second direction which crosses said first direction of extension of said center slit surface discharge electrodes;

forming surface discharge gaps each between adjacent said center slit surface discharge electrodes; and performing data write operation between said center slit surface discharge electrodes and said data electrodes by applying scanning pulses to said center slit surface discharge electrodes and by applying data pulses to said data electrodes;

wherein said split bus electrode electrically couples said pair of center slit surface discharge electrodes with each other at locations disposed outside of a display area.

9. A method of driving a plasma display panel as set forth in claim 8, further comprising:

grouping said center slit surface discharge electrodes alternately into C electrodes and S electrodes;

connecting a scanner driver to each of said S electrodes, said scanner driver supplying said scanning pulses;

grouping said discharge gaps to be driven for display to those of odd field and of even field;

in said odd field, applying said scanning pulses to said S electrodes of odd number to perform write operation between said S electrodes and said data electrodes;

in a retaining period of said scanning pulse, alternately applying retaining pulses to said S electrode and said C electrode of a pixel row of odd number which corresponds to said odd field;

applying in phase signals to said S electrode and said C electrode of a pixel row of even number which corresponds to said even field, thereby performing retained discharge of said pixel row of odd number;

in said even field, applying said scanning pulses to said S electrodes of even number to perform write operation between said S electrodes and said data electrodes;

in a retaining period of said scanning pulse, alternately applying retaining pulses to said S electrode and said C electrode of a pixel row of even number which corresponds to said even field; and applying in phase signals to said S electrode and said C electrode of a pixel row of odd number which corresponds to said odd field, thereby performing retained discharge of said pixel row of even number, thereby performing display operation in whole picture.

10. A method of driving a plasma display panel as set forth in claim 8, further comprising:

grouping said discharge gaps to be driven for display to those of odd field and of even field;

in said odd field, applying said scanning pulses to said center slit surface discharge electrodes of odd number to perform write operation between said electrodes and said data electrodes;

in a retaining period of said scanning pulse, alternately applying retaining pulses to said center slit surface discharge electrode of odd number and said center slit surface discharge electrode of even number;

performing light emission by retained discharge which is the same in two rows in said pixel rows on both sides of said center slit surface discharge electrode of odd number into which write operation is performed;

in said even field, applying said scanning pulses to said center slit surface discharge electrodes of even number to perform write operation between said electrodes and said data electrodes;

in a retaining period of said scanning pulse, alternately applying retaining pulses to said center slit surface discharge electrode of even number and said center slit surface discharge electrode of odd number;

performing light emission by retained discharge which is the same in two rows in said pixel rows on both sides of said center slit surface discharge electrode of even number into which write operation is performed, thereby performing display operation in whole picture.

11. A method of driving a plasma display panel as set forth in claim 8, further comprising:

grouping said discharge gaps to be driven for display into those of odd field and of even field;

in said odd field, applying said scanning pulses to said center slit surface discharge electrodes of odd number to perform write operation between said electrodes and said data electrodes;

in a retaining period of said scanning pulse, applying the same retaining pulses to said center slit surface discharge electrodes of even number adjacent to an upper portion or a lower portion of said center slit surface discharge electrode of odd number;

alternately applying said retaining pulses whose phases differ by a half pitch to said center slit surface discharge electrodes of even number adjacent lower portion or upper portion of said center slit surface discharge electrode of odd number;

performing light emission by retained discharge in said pixel row located on the lower or the upper side of said center slit surface discharge electrode of odd number;

in said even field, applying said scanning pulses to said center slit surface discharge electrodes of even number to perform write operation between said electrodes and said data electrodes;

in a retaining period of said scanning pulse, applying the same retaining pulses to said center slit surface discharge electrodes of odd number adjacent to an upper portion or a lower portion of said center slit surface discharge electrode of even number;

alternately applying said retaining pulses whose phases differ by a half pitch to said center slit surface discharge electrodes of odd number adjacent to a lower portion or an upper portion of said center slit surface discharge electrode of even number;

performing light emission by retained discharge in said pixel row located on the lower or the upper side of said center slit surface discharge electrode of even number, thereby performing display operation in whole picture.

12. A method of driving a plasma display panel as set forth in claim 10 or 11, wherein said method includes the ability to switchably perform the further features of said method of driving a plasma display.

* * * * *